US010261441B2

(12) United States Patent
Jimba et al.

(10) Patent No.: US 10,261,441 B2
(45) Date of Patent: Apr. 16, 2019

(54) DEVELOPER SUPPLY CONTAINER AND DEVELOPER SUPPLYING APPARATUS

(71) Applicant: CANON KABUSHIKI KAISHA, Tokyo (JP)

(72) Inventors: Manabu Jimba, Tsukuba (JP); Ayatomo Okino, Moriya (JP); Nobuyuki Yomoda, Kashiwa (JP); Yusuke Oizumi, Kasumigaura (JP); Akihito Kamura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/589,670

(22) Filed: May 8, 2017

(65) Prior Publication Data

US 2017/0242367 A1 Aug. 24, 2017

Related U.S. Application Data

(63) Continuation of application No. PCT/JP2015/082057, filed on Nov. 10, 2015.

(30) Foreign Application Priority Data

Nov. 10, 2014 (JP) ..... 2014-228136

(51) Int. Cl.
*G03G 15/08* (2006.01)
*G03G 15/06* (2006.01)

(52) U.S. Cl.
CPC ..... *G03G 15/0877* (2013.01); *G03G 15/0872* (2013.01); *G03G 15/0875* (2013.01); (Continued)

(58) Field of Classification Search
CPC ..... G03G 15/0877; G03G 15/0875; G03G 15/06; G03G 15/0822; G03G 15/0844; G03G 15/0865
See application file for complete search history.

(56) References Cited

U.S. PATENT DOCUMENTS 7,050,728 B2 5/2006 Minagawa et al.
8,000,614 B2 8/2011 Okino et al.
(Continued)

FOREIGN PATENT DOCUMENTS

EP 2 416 222 A1 2/2012
JP 2010-256894 A 11/2010
(Continued)

OTHER PUBLICATIONS

International Search Report and Written Opinion for International Patent Application No. PCT/JP2015/082057 published Jan. 12, 2016.
(Continued)

*Primary Examiner* — Rodney A Bonnette
(74) *Attorney, Agent, or Firm* — Venable LLP

(57) ABSTRACT

A developer supply container includes a developer accommodating chamber capable of accommodating developer, a storage portion provided in the developer accommodating chamber and capable of storing a predetermined amount of the developer to be discharged through a discharge opening, and a pump portion actable on the storage portion. A suppressing portion is provided, with the suppressing portion being capable of suppressing air directed toward the developer accommodating chamber from the pump portion, and with the suppressing portion permitting supply of air from the pump portion to the storage portion in a discharge operation.

16 Claims, 22 Drawing Sheets

(52) U.S. Cl.
CPC ..... *G03G 15/06* (2013.01); *G03G 15/0822* (2013.01); *G03G 15/0844* (2013.01); *G03G 15/0865* (2013.01)

(56) References Cited

U.S. PATENT DOCUMENTS

| | | | | |
|---|---|---|---|---|
| 9,152,088 | B1* | 10/2015 | Kobori | G03G 15/0865 |
| 9,213,262 | B2 | 12/2015 | Nagashima et al. | |
| 9,348,261 | B2 | 5/2016 | Enokuchi et al. | |
| 9,354,549 | B1 | 5/2016 | Okino et al. | |
| 9,529,299 | B2 | 12/2016 | Okino et al. | |
| 9,535,369 | B2 | 1/2017 | Kamura et al. | |
| 9,588,461 | B2 | 3/2017 | Kamura et al. | |
| 9,811,024 | B2 | 11/2017 | Yomoda et al. | |
| 2012/0014713 | A1* | 1/2012 | Murakami | G03G 15/0865 399/119 |
| 2012/0014722 | A1 | 1/2012 | Okino et al. | |
| 2013/0209134 | A1* | 8/2013 | Okino | G03G 15/0875 399/258 |
| 2013/0209140 | A1* | 8/2013 | Murakami | G03G 15/0875 399/258 |
| 2014/0169836 | A1 | 6/2014 | Nagashima et al. | |
| 2015/0277285 | A1 | 10/2015 | Okino et al. | |
| 2015/0277287 | A1* | 10/2015 | Nakajima | G03G 15/0887 399/260 |
| 2015/0378278 | A1* | 12/2015 | Kamura | G03G 15/0867 399/262 |
| 2016/0004186 | A1 | 1/2016 | Jimba et al. | |
| 2016/0004187 | A1 | 1/2016 | Yomoda et al. | |
| 2016/0004188 | A1* | 1/2016 | Kamura | G03G 15/0872 399/260 |
| 2016/0011540 | A1* | 1/2016 | Yamaoka | G03G 15/0872 399/260 |
| 2016/0091824 | A1* | 3/2016 | Kobori | G03G 15/0877 399/259 |
| 2016/0131993 | A1* | 5/2016 | Okino | G03G 15/0872 399/262 |
| 2016/0139536 | A1* | 5/2016 | Okino | G03G 15/0812 399/262 |
| 2016/0223981 | A1 | 8/2016 | Enokuchi et al. | |
| 2017/0060027 | A1* | 3/2017 | Yomoda | G03G 15/087 |
| 2017/0060028 | A1* | 3/2017 | Jimba | G03G 15/0881 |
| 2017/0060029 | A1 | 3/2017 | Yomoda | |
| 2017/0146926 | A1 | 3/2017 | Kamura et al. | |
| 2017/0343925 | A1* | 11/2017 | Saito | G03G 15/0822 |
| 2017/0351212 | A1 | 12/2017 | Enokuchi et al. | |
| 2018/0024465 | A1* | 1/2018 | Yomoda | G03G 15/0872 |

FOREIGN PATENT DOCUMENTS

| | | | |
|---|---|---|---|
| JP | 2012-293735 | A | 5/2012 |
| JP | 2013-047714 | A | 3/2013 |
| JP | 2014-182266 | A | 9/2014 |
| JP | 2014-186138 | A | 10/2014 |

OTHER PUBLICATIONS

Extended Search Report in European Patent Application No. 15859805.2, dated May 2, 2018.
Office Action in Japanese Patent Application No. 2014-228136, dated Jul. 3, 2018.
Office Action in Japanese Patent Application No. 2014-228136, dated Feb. 5, 2019.

* cited by examiner (a)

(b)

(a)

(b)

(c)

DEVELOPER SUPPLY CONTAINER AND DEVELOPER SUPPLYING APPARATUS

FIELD OF THE INVENTION

The present invention relates to a developer supply container detachably mountable to a developer supplying apparatus and also relates to the developer supplying apparatus. The developer supplying apparatus is used with an image forming apparatus such as a copying machine, a facsimile machine, a printer or a complex machine having functions of a plurality of such machines.

BACKGROUND ART

The apparatus disclosed in Japanese Laid-open Patent Application 2010-256894 employs a system in which the developer is discharged using a bellow pump provided in the supply container. More particularly, the bellow pump is expanded to provide a pressure lower than the ambient pressure in the supply container, so that the air is taken into the supply container to fluidize the developer. In addition, the bellow pump is contracted to provide a pressure higher than the ambient pressure in the supply container, so that the developer is pushed out by the pressure difference between the inside and the outside of the supply container, thus discharging the developer. By repeating the two steps alternately, the developer is stably discharged.

In the apparatus disclosed in 2014-186138, a storage portion accommodating a constant amount of the developer is provided adjacent to the discharge opening, by which the amount of the flow of the developer into the storage portion is controlled. With this structure, more stabilized discharging property is accomplished than that of the supply container disclosed in the Japanese Laid-open Patent Application 2010-256894.

However, in the apparatus disclosed in Japanese Laid-open Patent Application 2010-256894 or 2014-186138, the use is made with a bellow pump to produce a pressure difference between the total inside volume of the supply container and outside of the supply container. Therefore, a large pressure difference is required between the inside of the developer accommodating chamber of the supply container and the outside in order to assure that the developer is sufficiently loosened and to stably discharged from the beginning, even in the case that the developer of the storage portion provided adjacent to the discharge opening inside the supply container is packed during the transportation or the like of the supply container. As a result, an expansion and contraction amount of the bellow pump is required to be large, or the inside volume of the bellow pump is required to be large. Then, the size of the supply container is large, thus requiring a large space for the supply container in the main assembly of the image forming apparatus. Under the circumstances, the structure for enhancing concentration of the air to the discharge opening during the toner discharging is desired.

Problem to be Solved by the Invention

It is another object of the present invention to provide a developer supply container in which the concentration of the air to the discharging portion during the toner discharging can be enhanced, so that the developer can be stably discharged.

Means for Solving the Problem

According to an aspect of the present invention, there is provided a developer supply container detachably mountable to a developer supplying apparatus, said developer supply container comprising a developer accommodating chamber capable of accommodating a developer; a discharge opening, provided on said developer accommodating chamber, for permitting discharge of the developer therein; a storage portion provided in said developer accommodating chamber and capable of storing a predetermined amount of the developer through said discharge opening; a pump portion having a changeable inside volume with reciprocation and actable at least on said storage portion; an air hole portion providing fluid communication between said pump portion and said storage portion; and a suppressing portion capable of suppressing air directing toward said developer accommodating chamber from said pump portion while permitting supply of air from said pump portion to said air hole portion, at least in a discharging operation.

Effect of the Invention

According to the present invention, the air can be concentrated to the discharging portion during the toner discharging, and therefore, the developer can be stably discharged.

Figure 2:
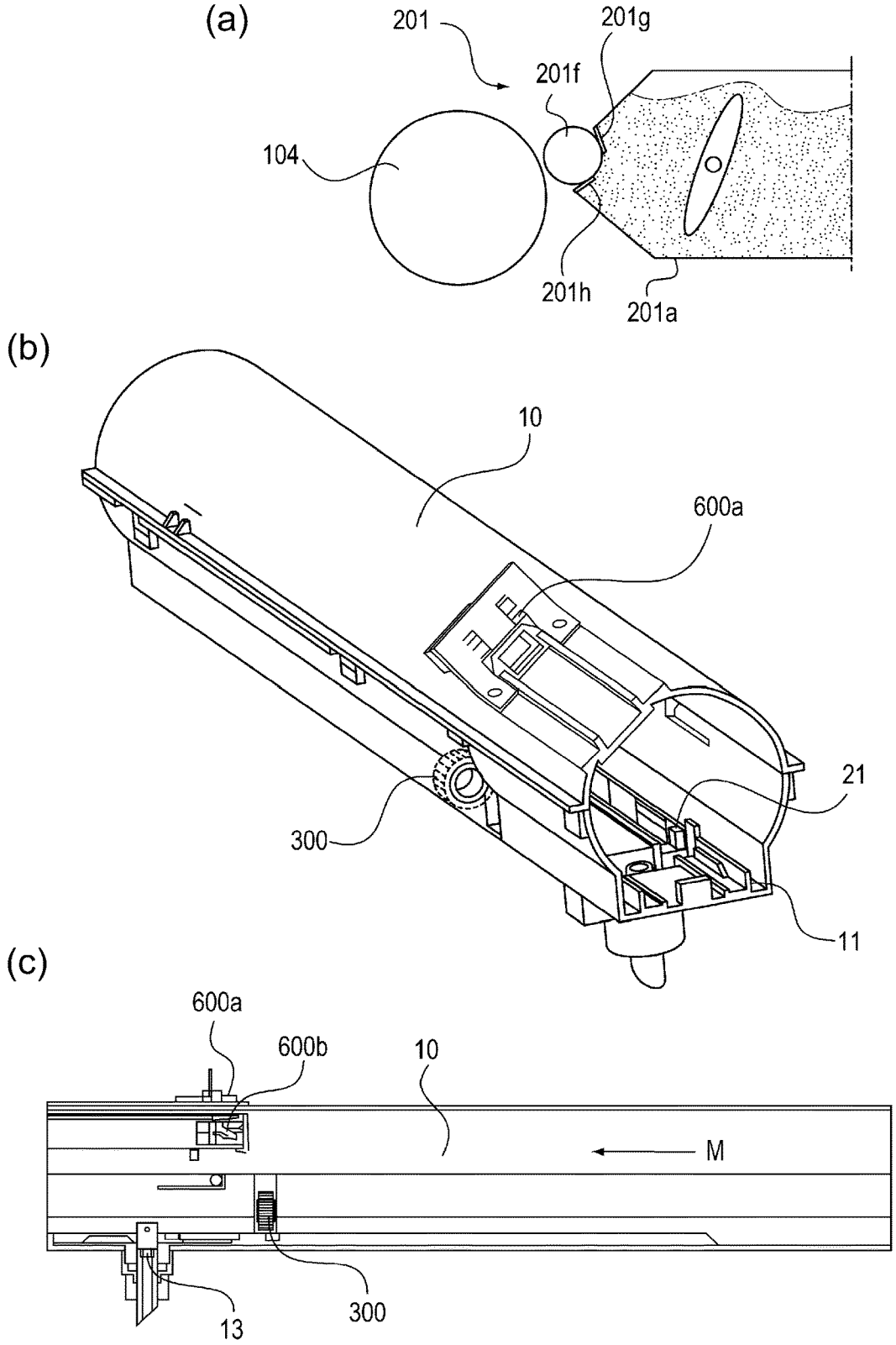

Part (a) of FIG. 2 is a partially sectional view of the developer supplying apparatus, (b) is a perspective view of a mounting portion for mounting the supply container, and (c) is a sectional view of the mounting portion.

Figure 3:
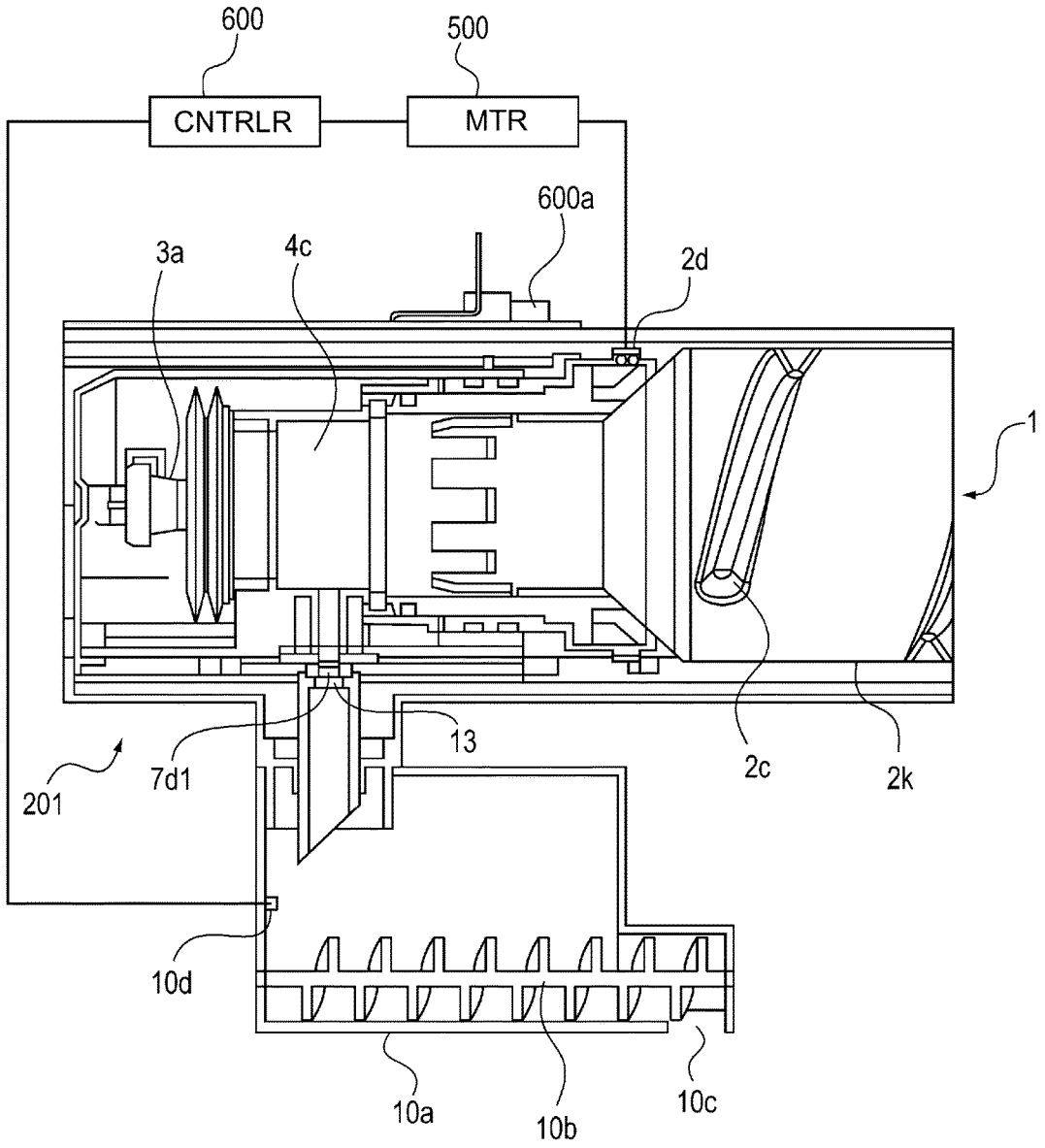

FIG. 3 shows a control system and a partially enlarged view of the supply container and the supplying device.

Figure 4:
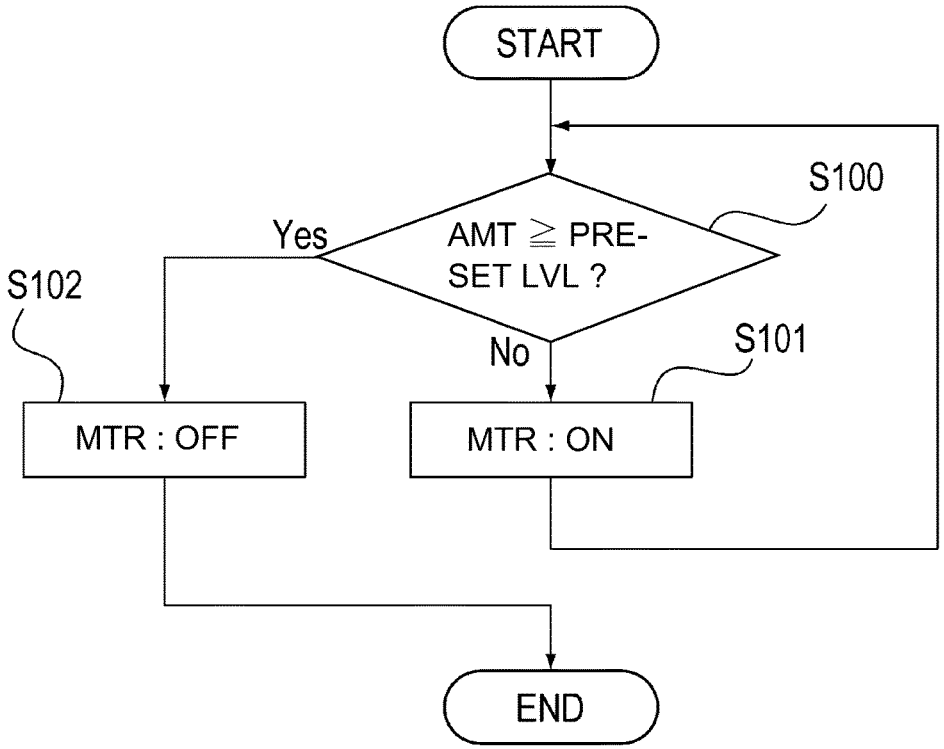

FIG. 4 is a flow chart illustrating a flow of developer supply operation controlled by the control system.

Figure 5:
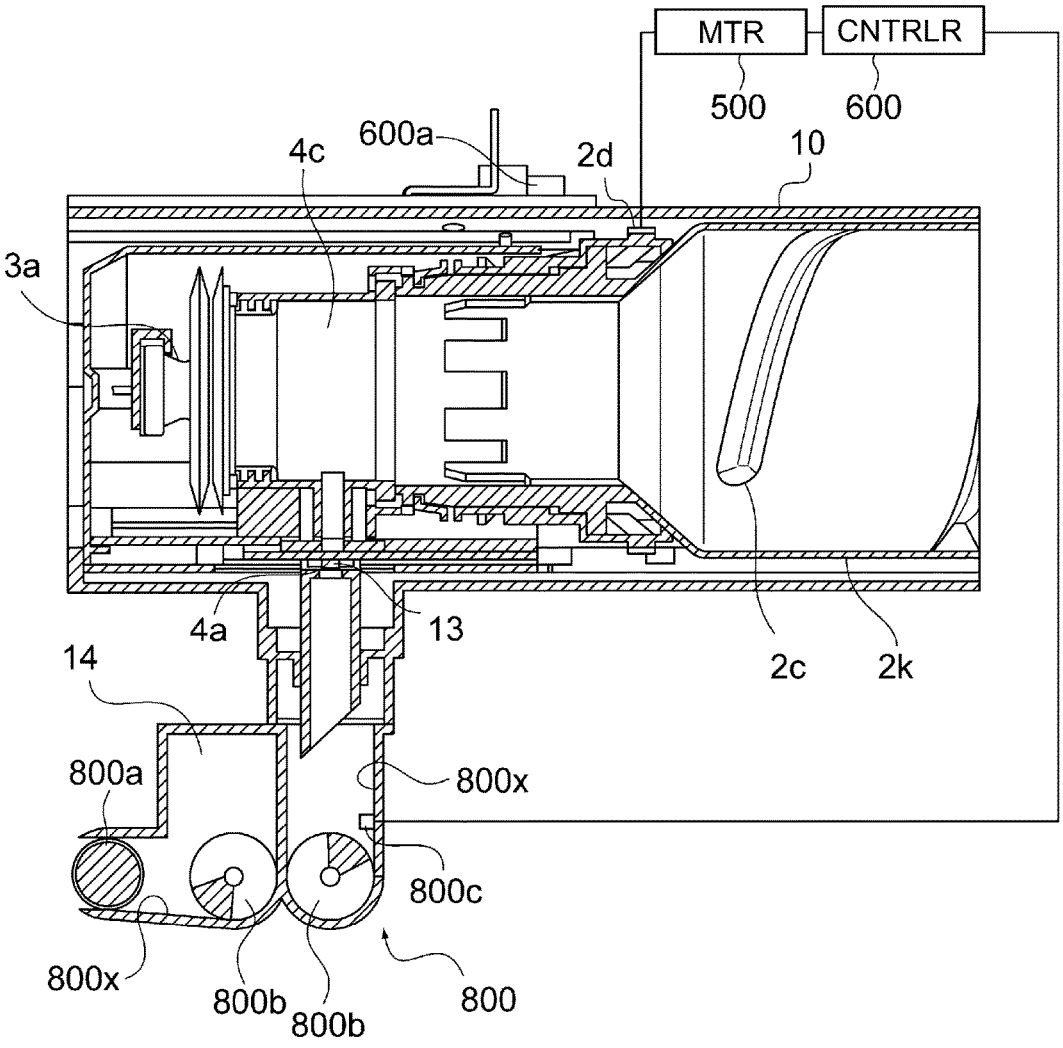

FIG. 5 is a sectional view illustrating a structure in which the developer is supplied directly (without use of a hopper) into a developing device from the supply container.

Figure 6:
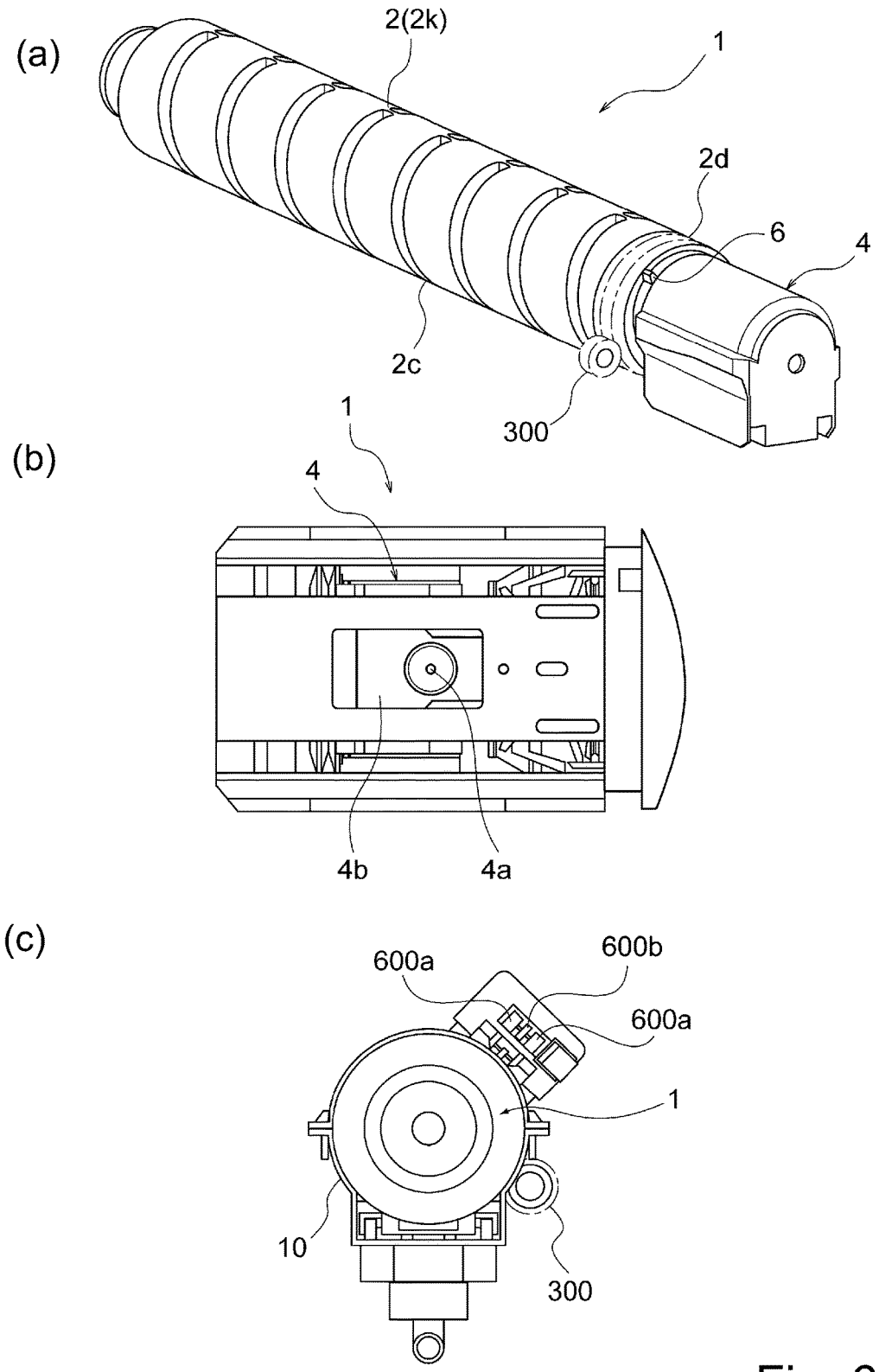

FIG. 6 (*a*) is a perspective view of an entirety of the supply container, FIG. 6 (*b*) is a partially enlarged view of the elements around a discharge opening of the supply container, FIG. 6 (*c*) is a front view illustrating a state in which the supply container is mounted to the mounting portion.

Figure 7:
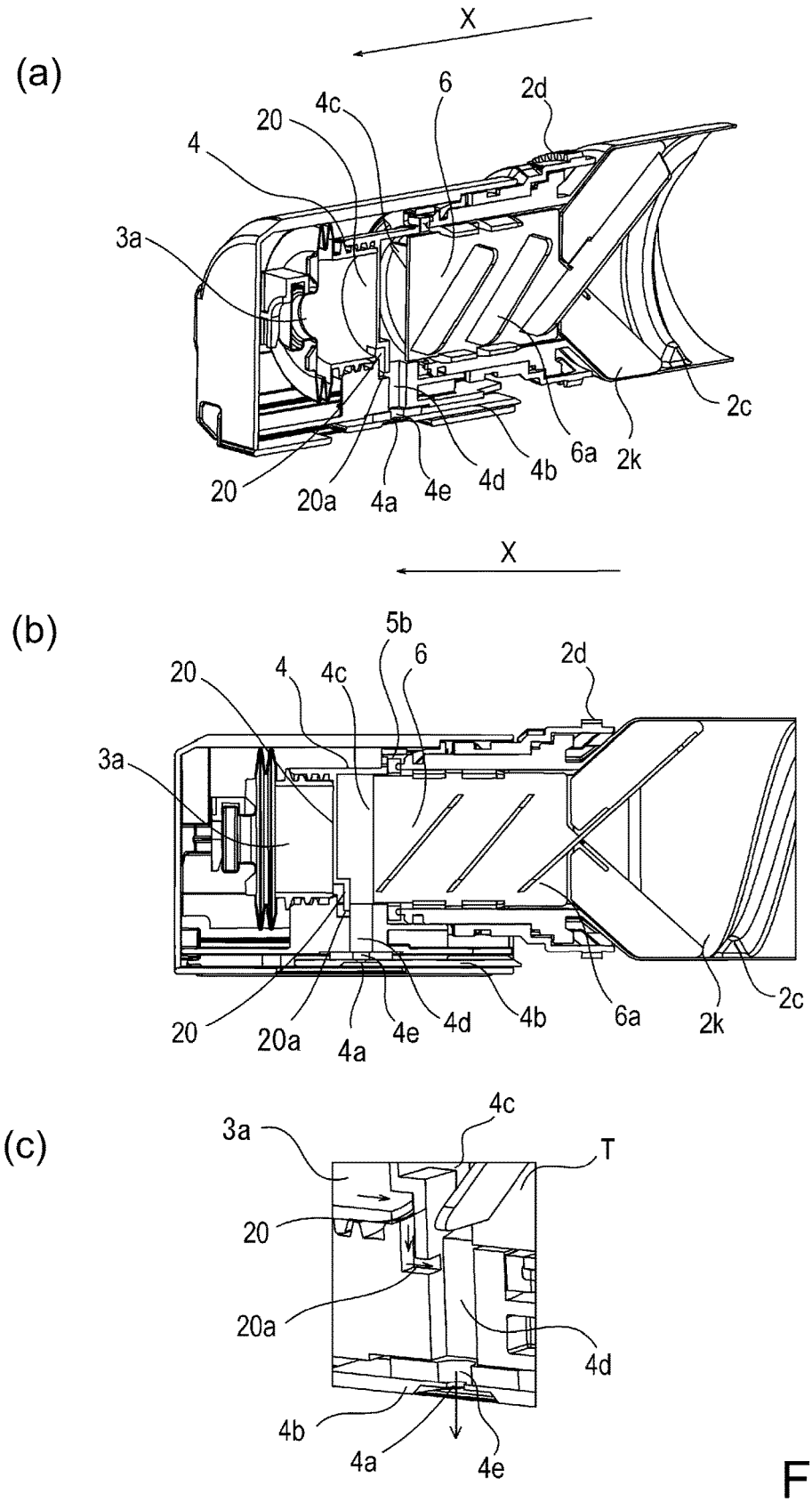

Part (a) of FIG. 7 is a sectional perspective view of the supply container, (b) is a partially sectional view in a state in which the pump portion is expanded to the maximum usable limit, and (c) is a partially sectional view in a state in which the pump portion is contracted to the maximum usable limit.

Figure 8:
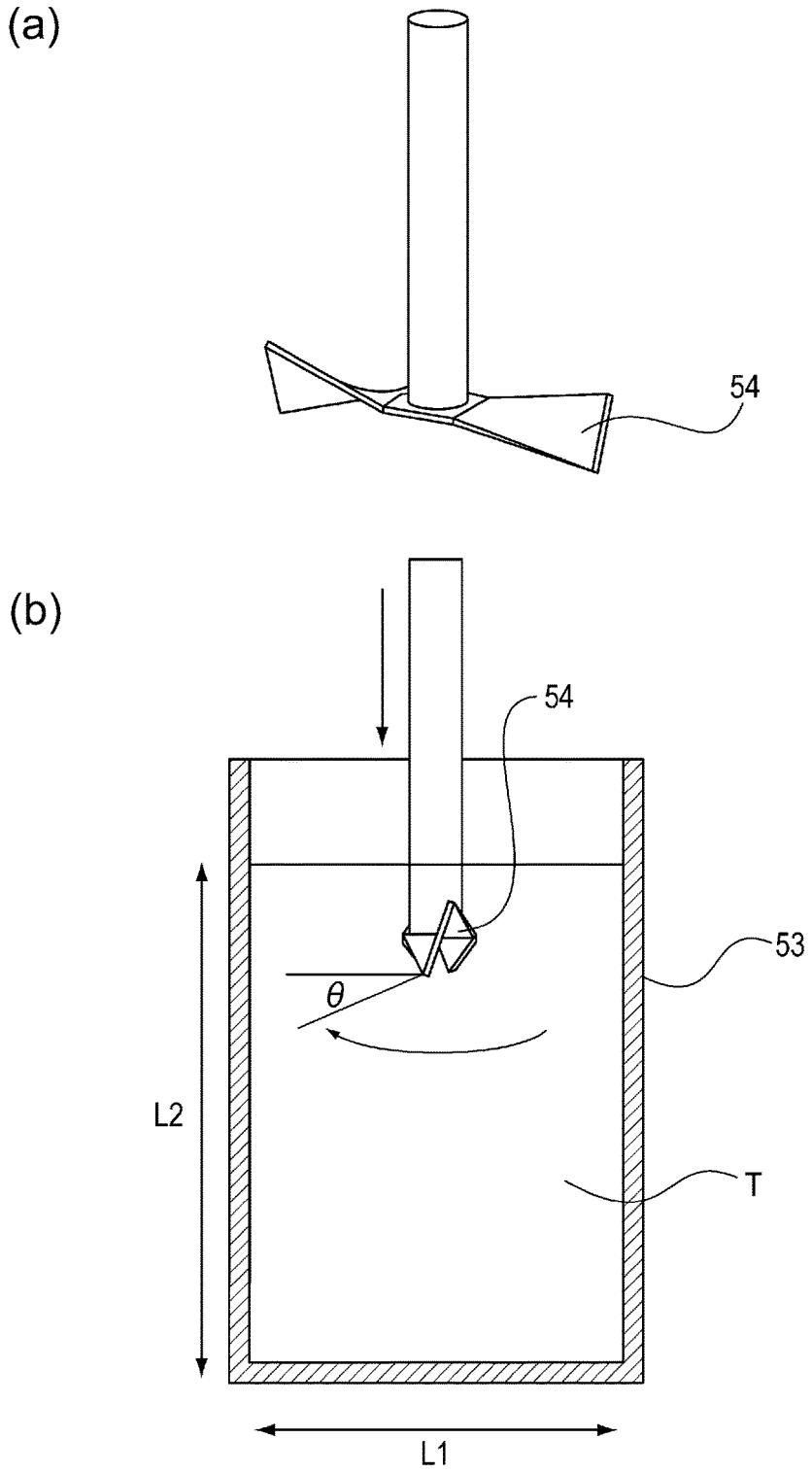

Parts (a) and (b) of FIG. 8 are schematic views of a device for measuring fluidity energy.

Figure 9:
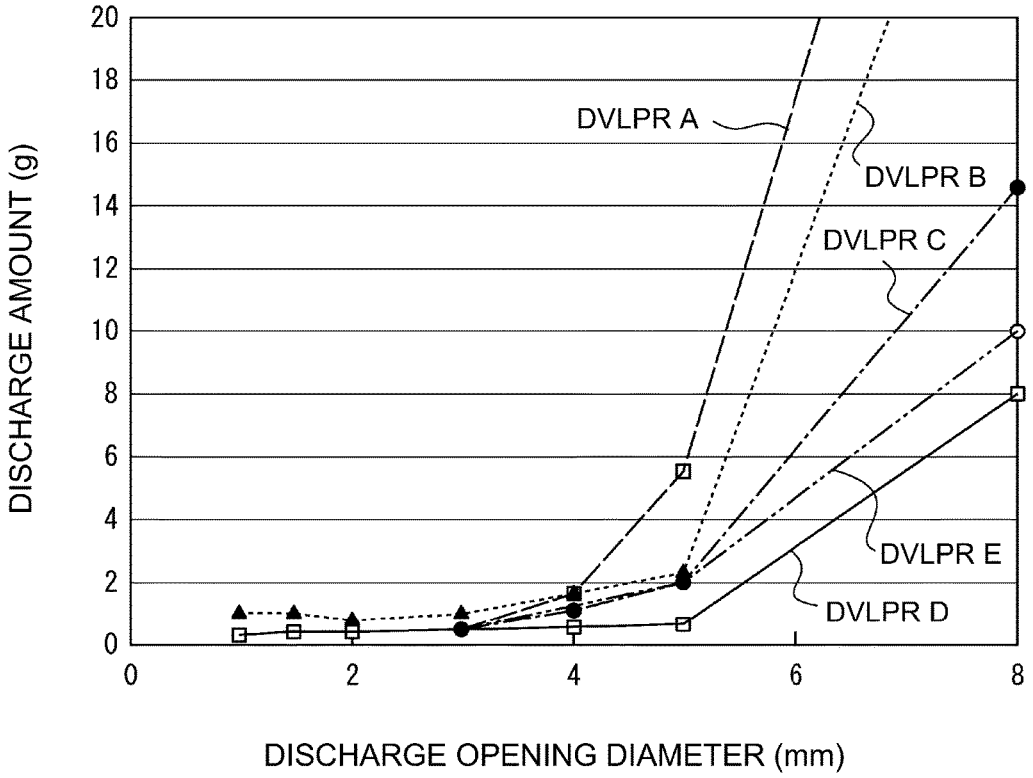

FIG. 9 is a graph showing a relation between a diameter of a discharge opening and a discharge amount, for various developers.

Figure 10:
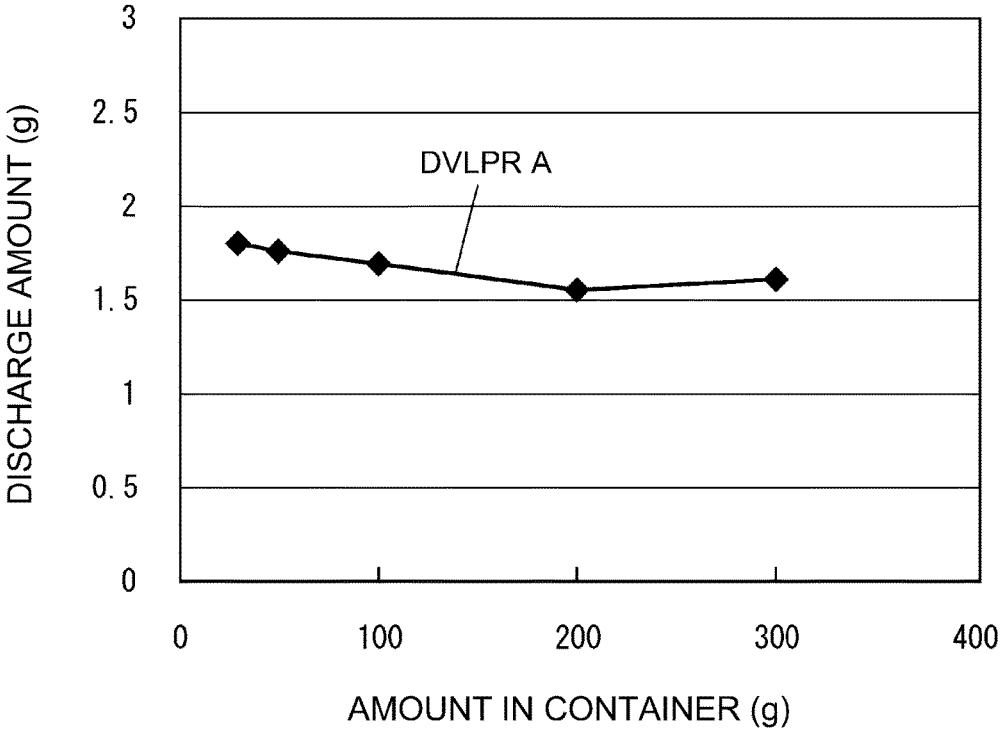

FIG. 10 shows a relationship between a developer discharge amount and an amount of the developer in the container, for the developer T.

Figure 11:
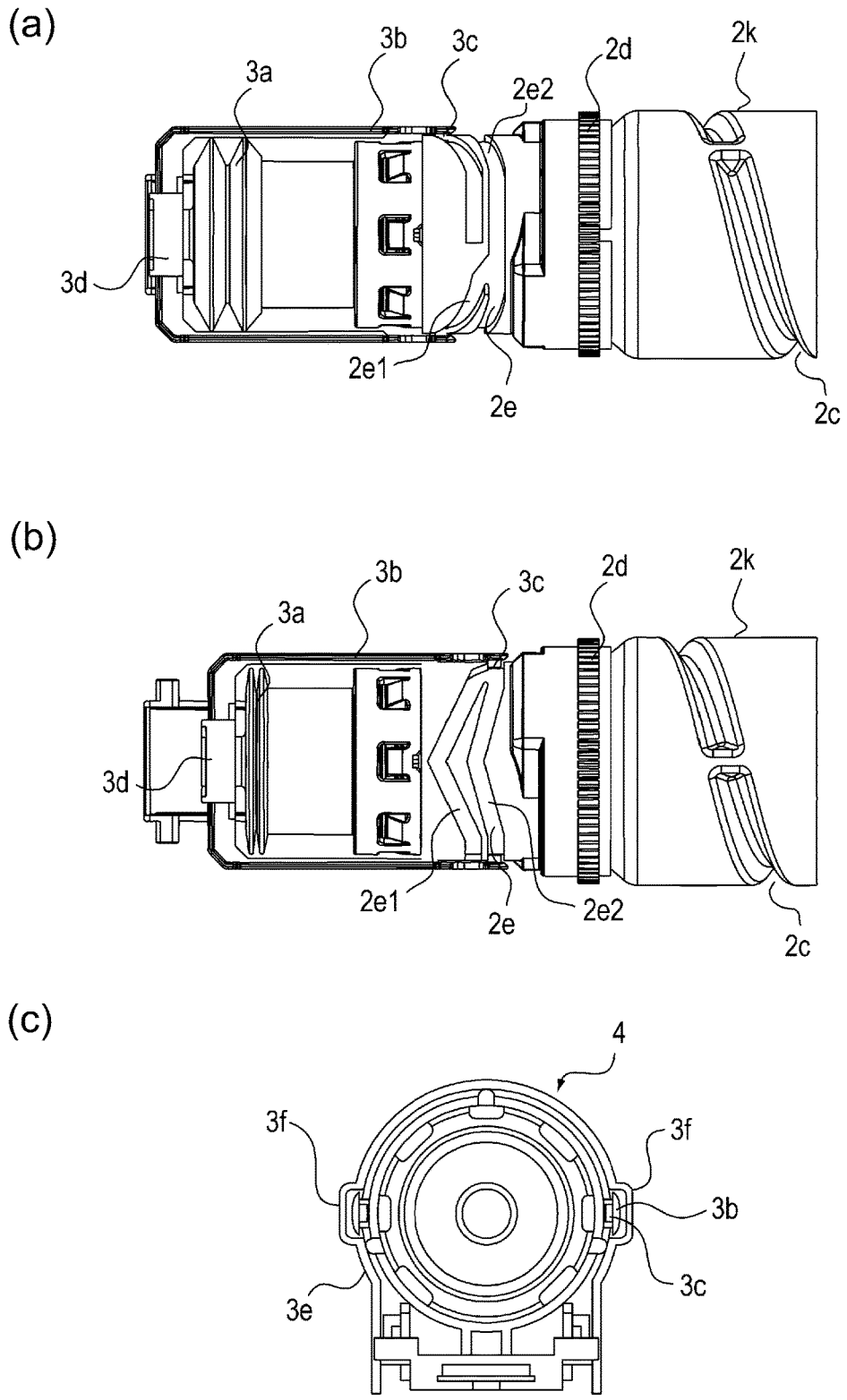

Part (a) of FIG. 11 is a partial view in a state in which the pump portion is expanded to the maximum usable limit, (b) is a partial view in a state in which the pump portion is contracted to the maximum usable limit, and (c) is a partial view of the pump portion.

Figure 12:
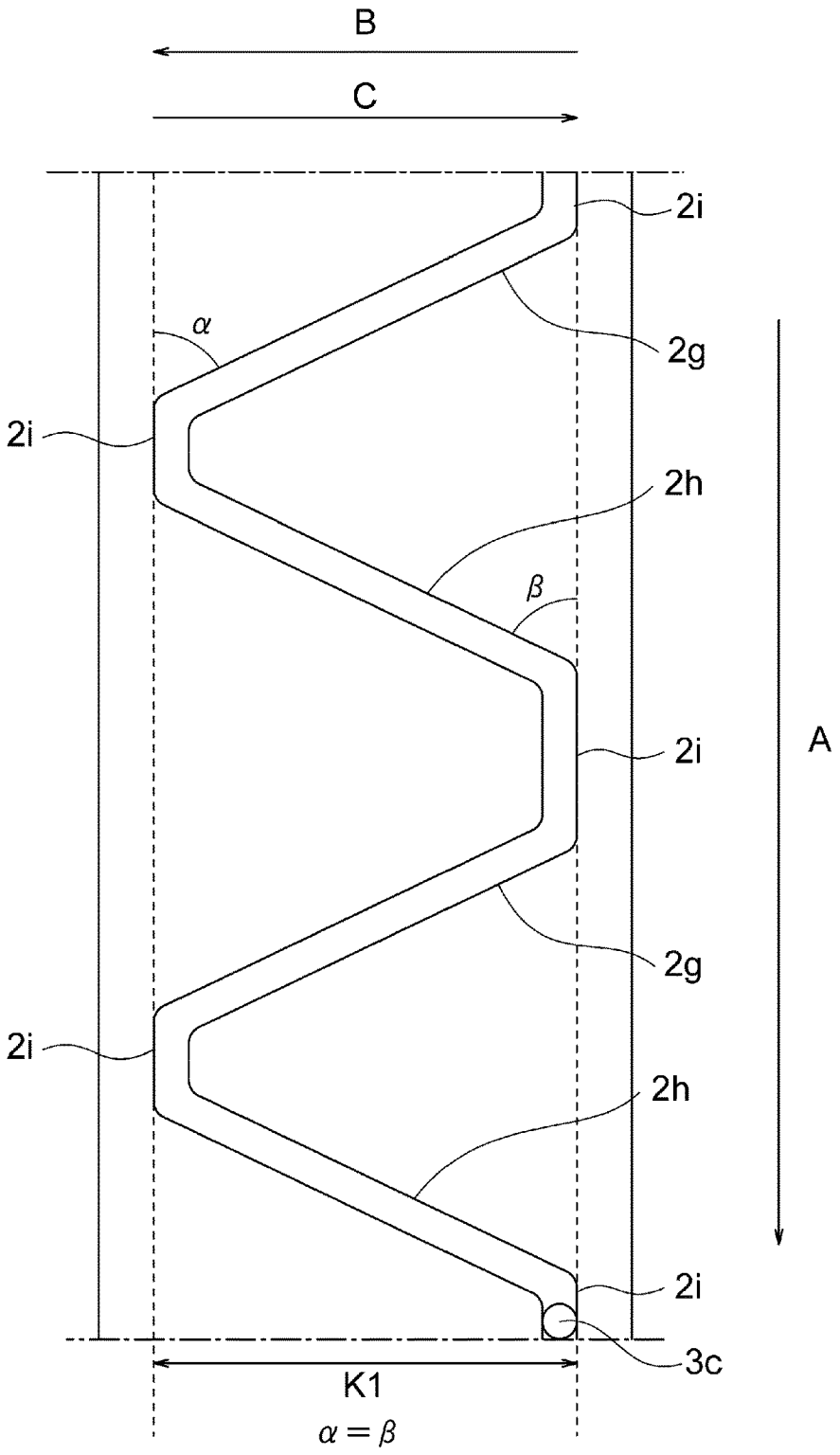

FIG. 12 is a development of the cam groove in the driving force converting mechanism (cam mechanism comprising the engaging projection and the cam)

Figure 13:
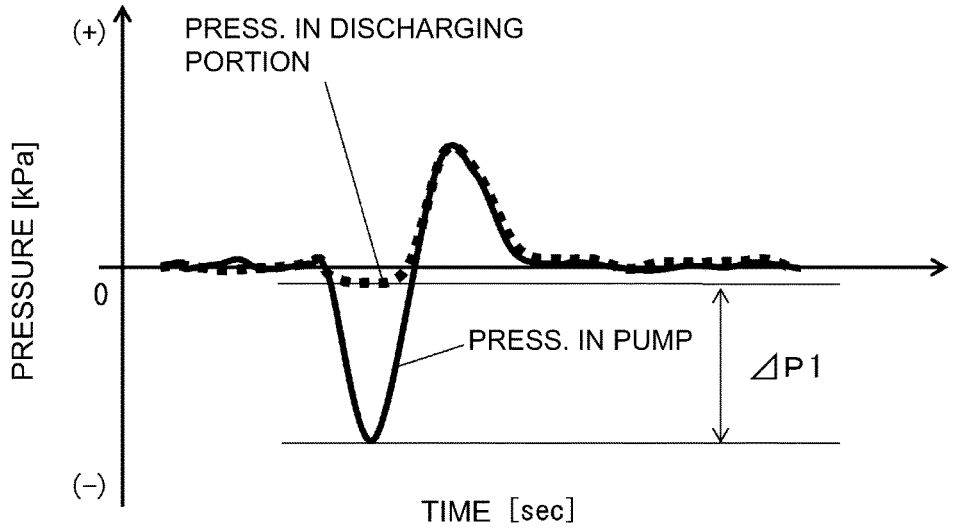
Figure 13:
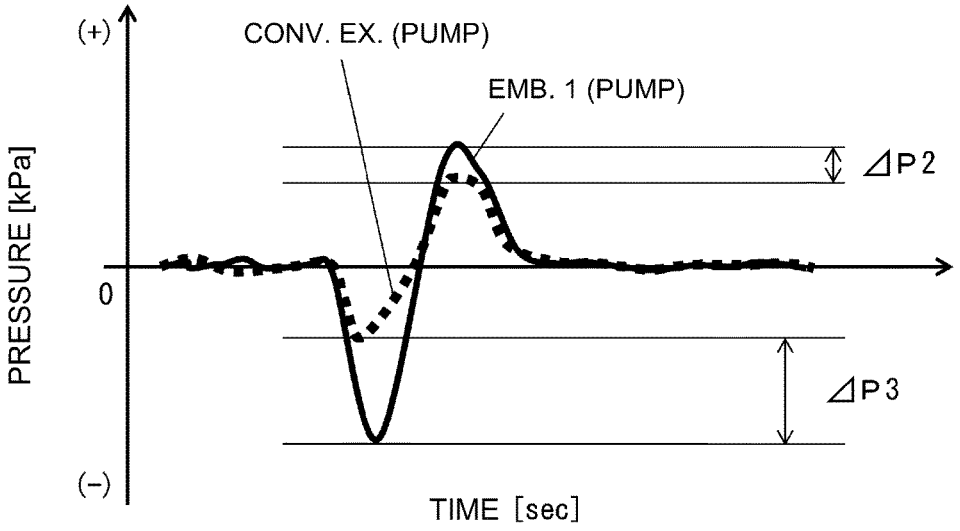

FIG. 13 is graphs showing changes of the pressure in the expanding-and-contracting operation of the pump portion in the state that the shutter of the supply container is opened so that the second discharge opening is opened to the outside air.

Figure 14:
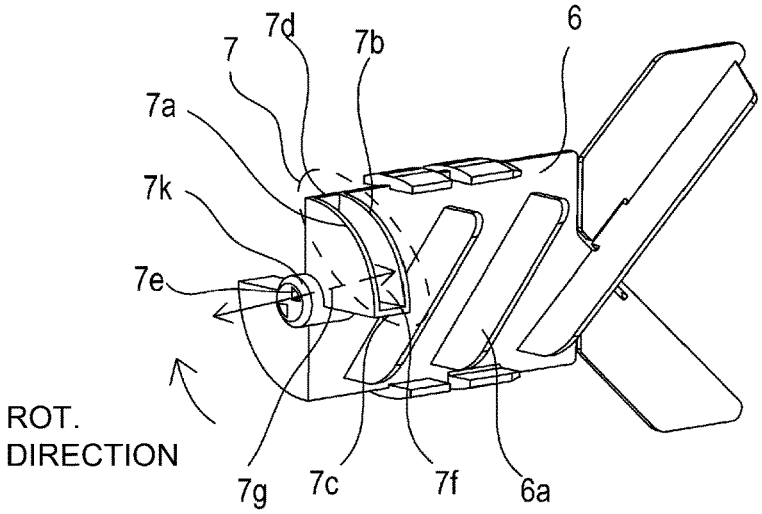
Figure 14:
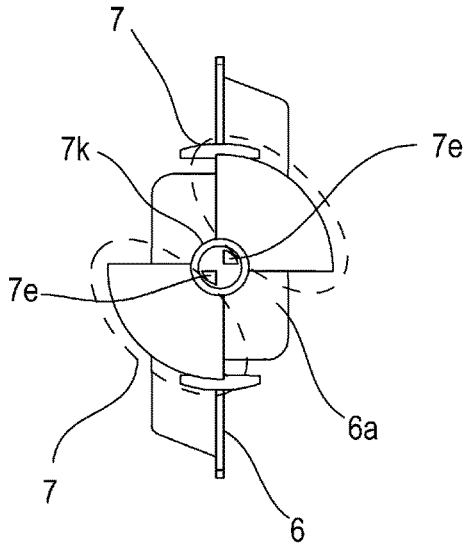
Figure 14:
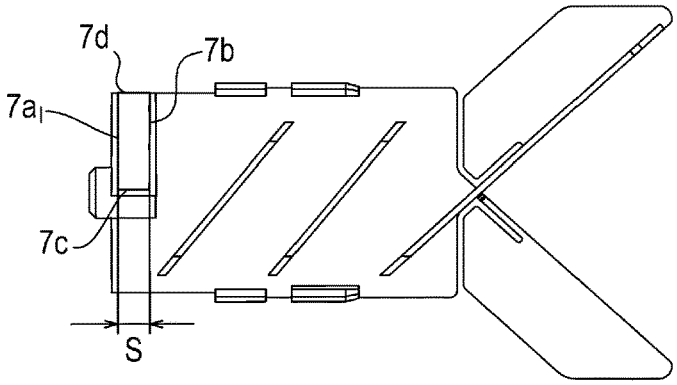

Part (a) of FIG. 14 is a perspective view of the feeding member provided in the supply container, part (b) of FIG. 14 is a side view of the feeding member, and part (c) of FIG. 14 is a front view of the feeding member.

Figure 15:
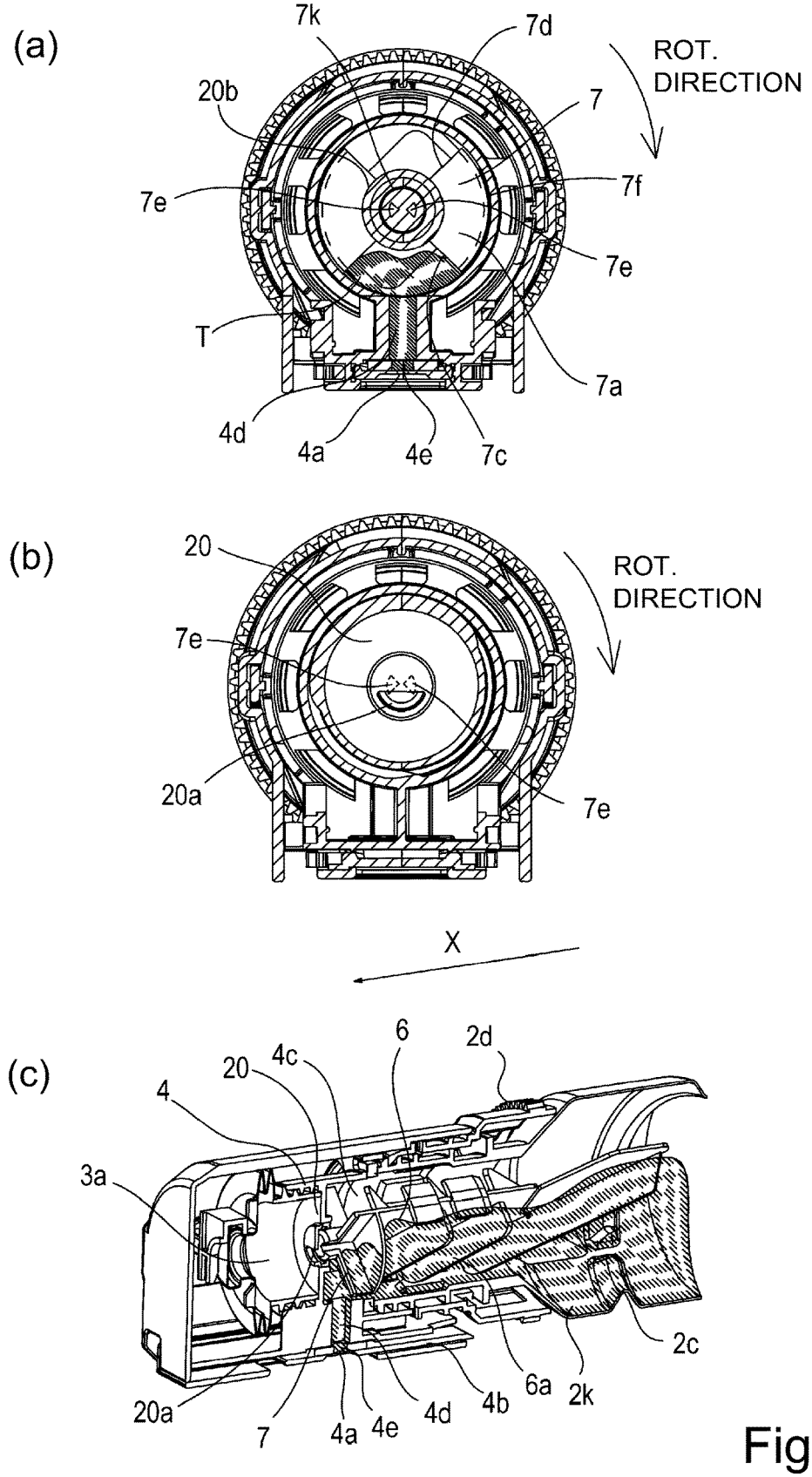

FIG. 15 shows the state of the supply container in the operation rest step in which the pump portion does not operate.

Figure 16:
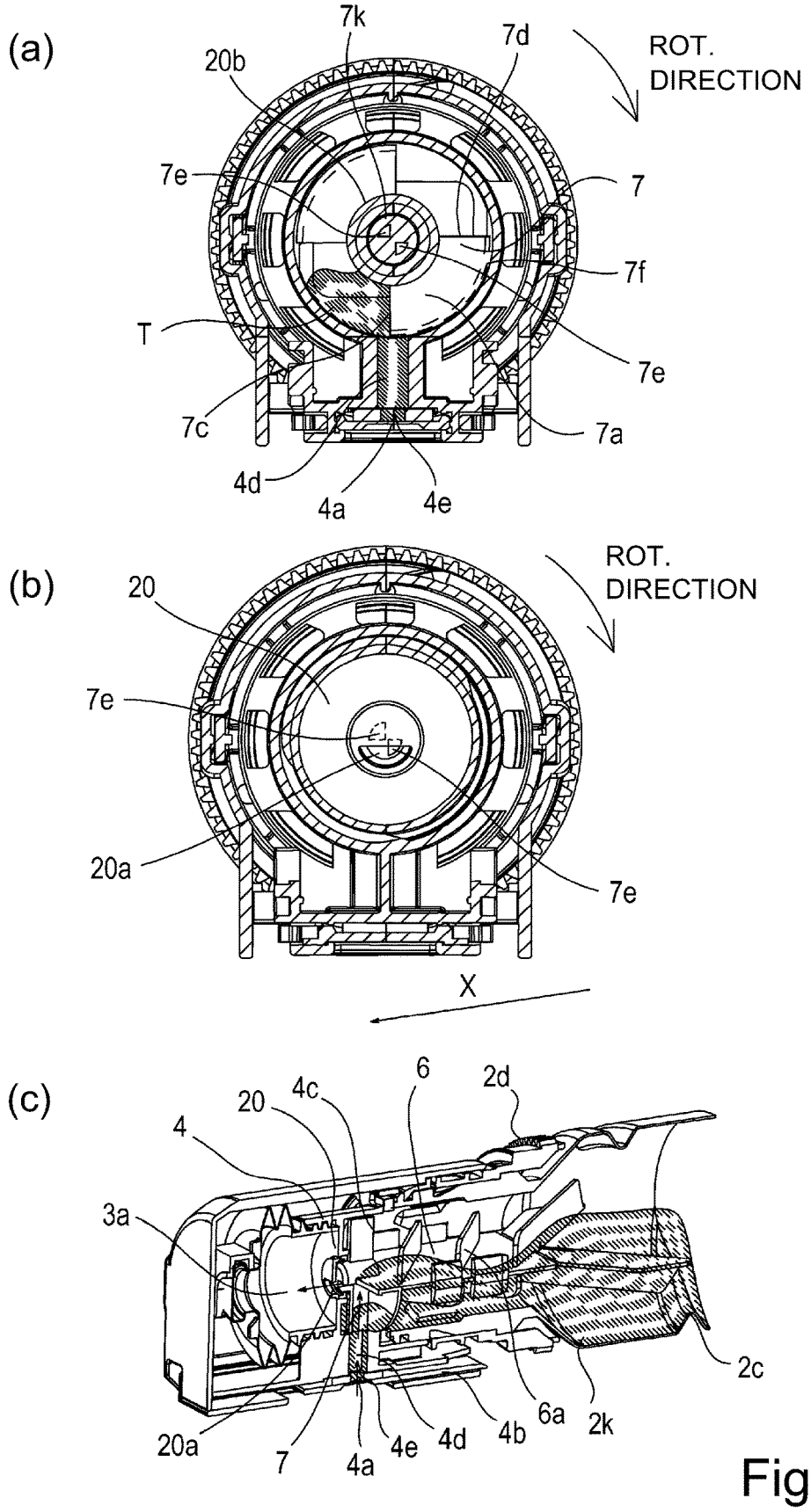

FIG. 16 shows a suction stroke which is partway from the most contracted state of the pump to the most expanded state thereof.

Figure 17:
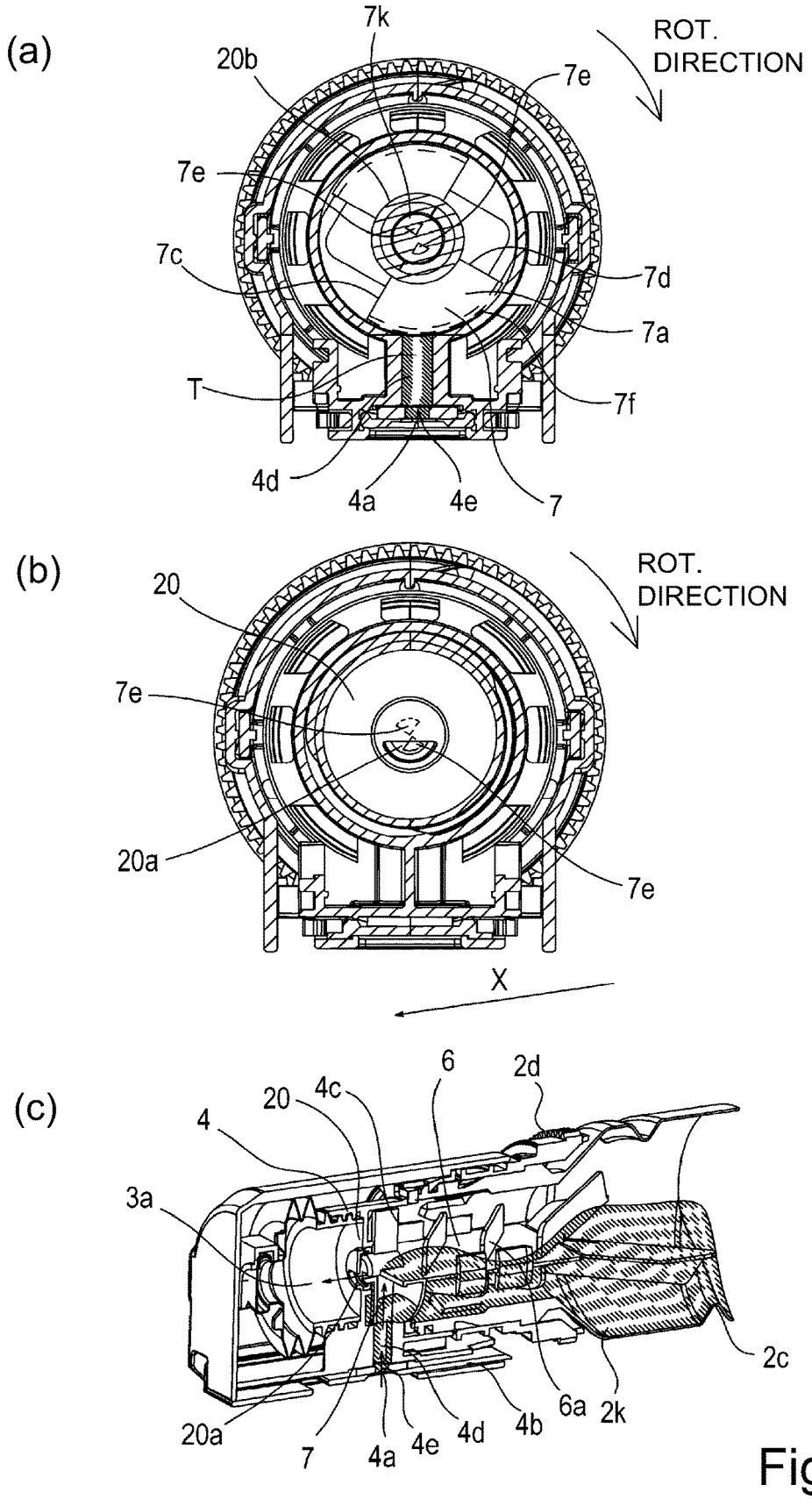

FIG. 17 shows a discharging stroke which is partway from the most expanded state of the pump to the most contracted state thereof.

Figure 18:
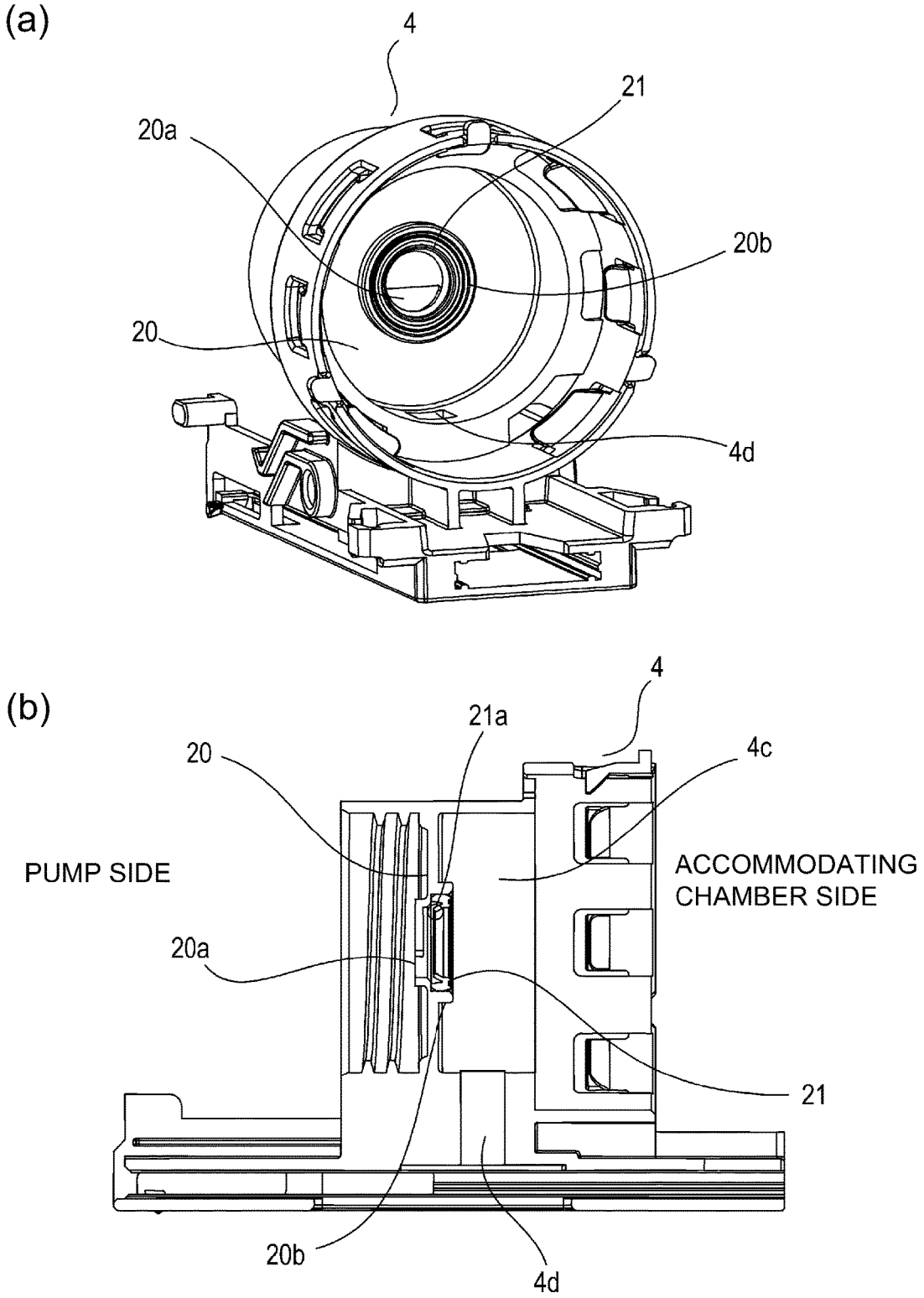

Part (a) of FIG. 18 is a perspective view of the flange portion of the supply container according to Embodiment 2, as seen from the accommodation chamber side, and part (b) is a sectional view of the flange portion.

Figure 19:
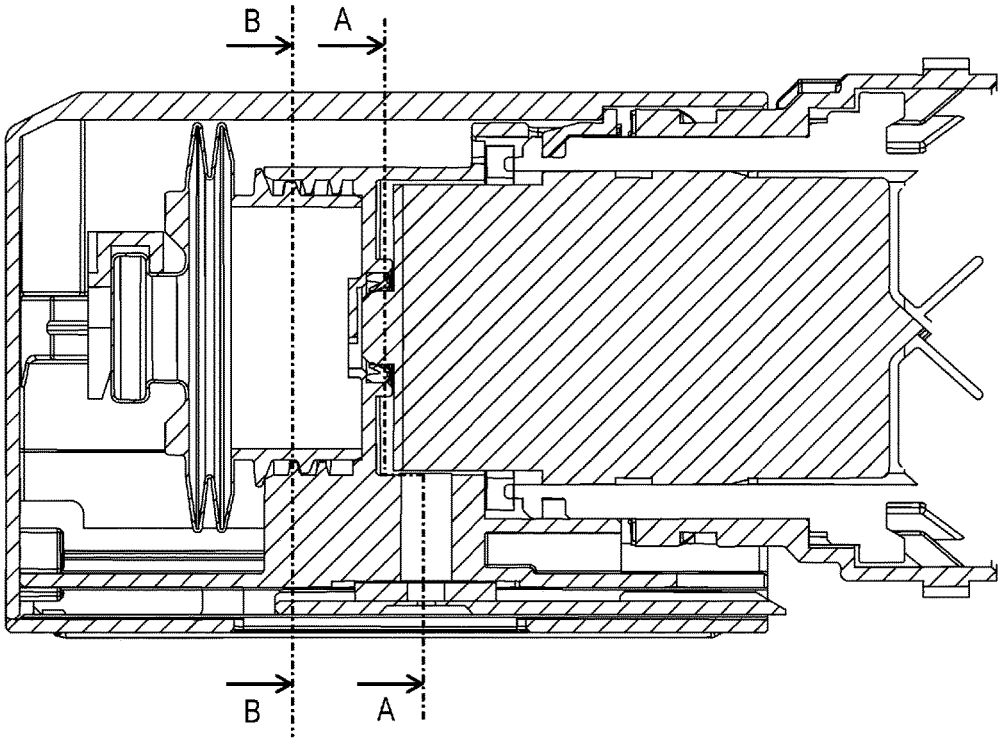

FIG. 19 is a sectional view of the developer supply container.

Figure 20:
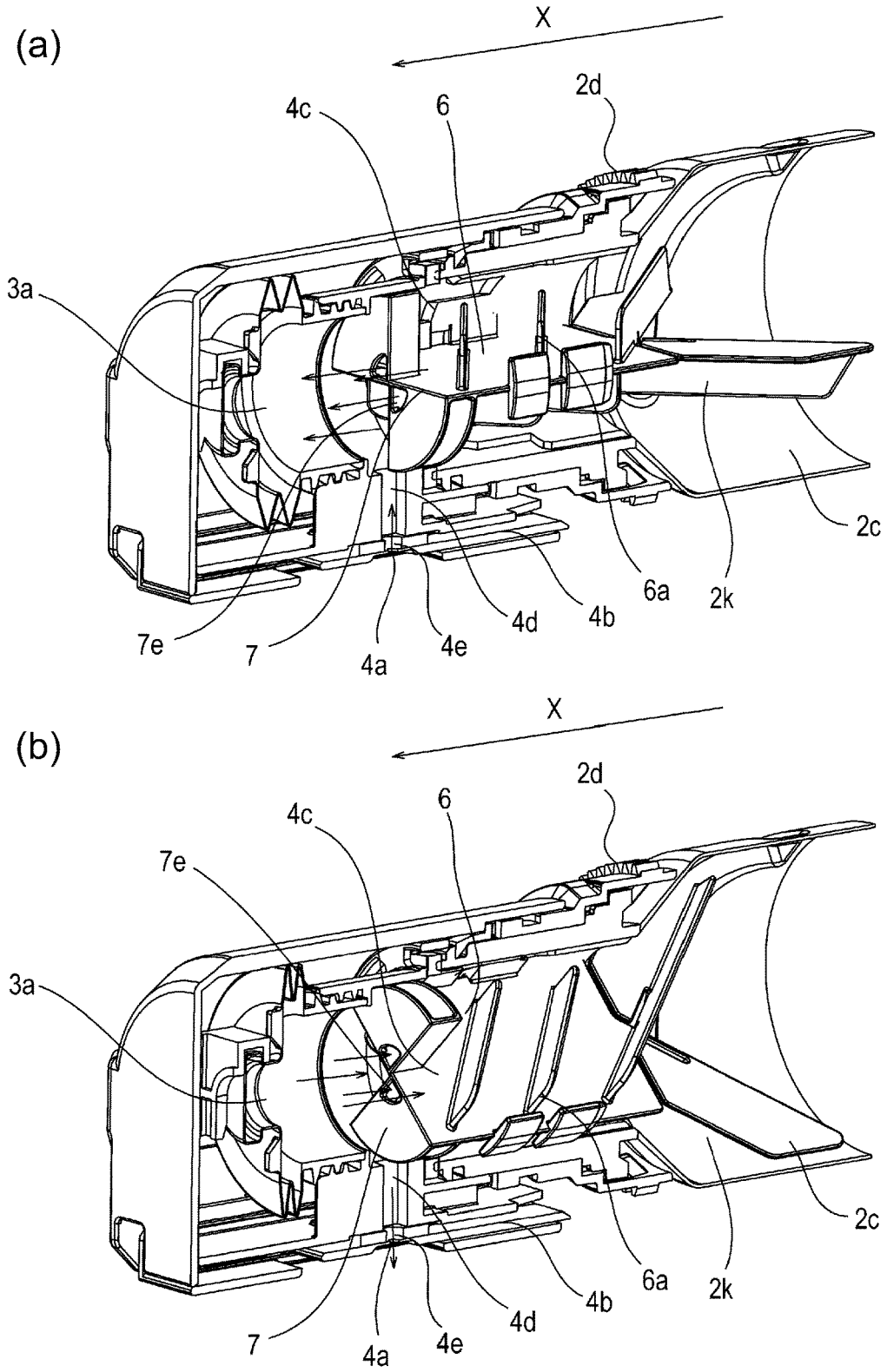

FIG. 20 is a partly enlarged perspective view of the supply container according to a comparison example (conventional example).

Figure 21:
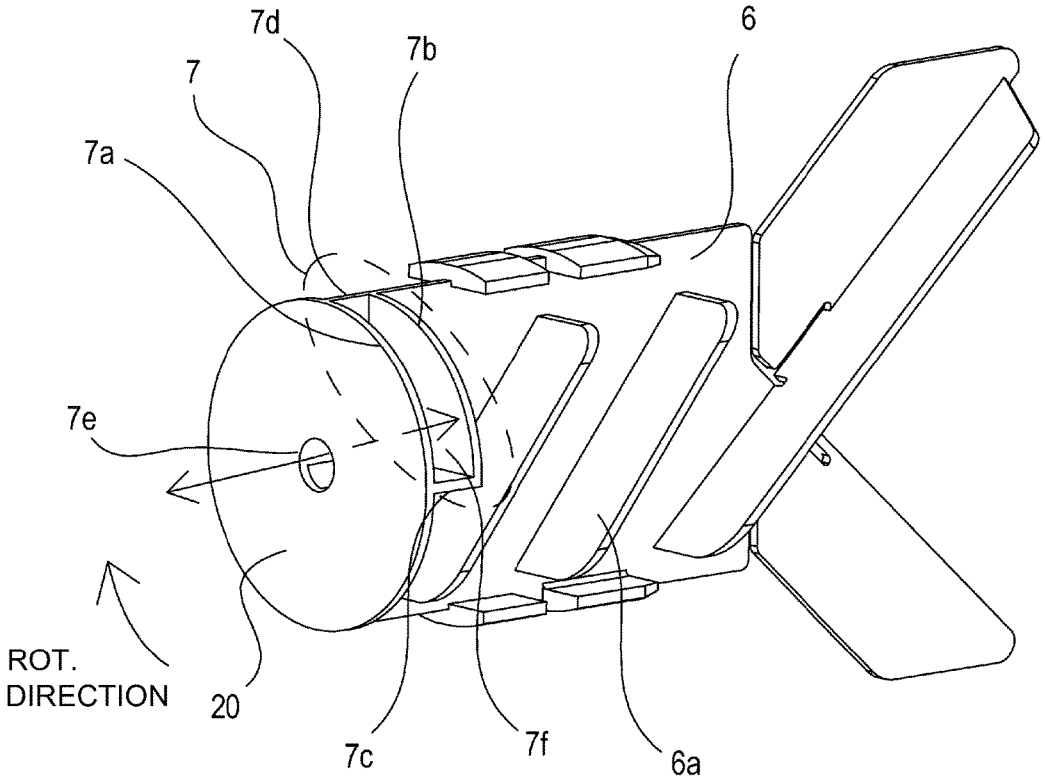

FIG. 21 is an enlarged perspective view of the feeding member of the supply container according to a modified example of Embodiment 2.

Figure 22:
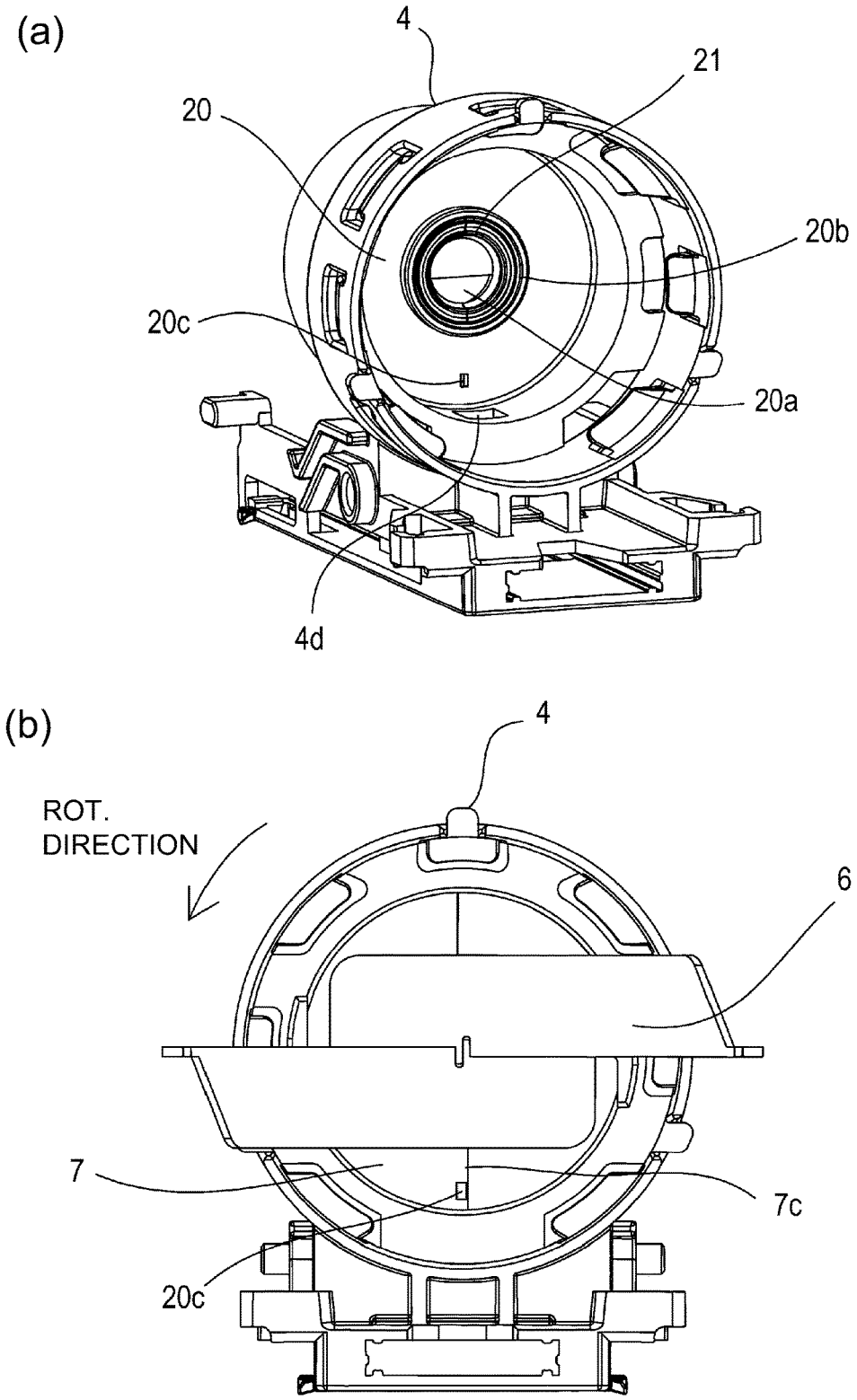

Part (a) of FIG. 22 is a perspective view of the flange in the supply container according to Embodiment 3, and part (b) of FIG. 22 is a sectional view illustrating a positional relation of the feeding member and the flange portion in the discharging stroke in this embodiment.

DESCRIPTION OF THE EMBODIMENTS

Embodiments of the present invention will be described in detail in conjunction with the accompanying drawings. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. In the description of the embodiments, the same reference numerals as in the previous embodiment are assigned to the elements having the corresponding functions in this embodiment, and the detailed description thereof is omitted for simplicity.

[Embodiment 1]

First, basic structures of an image forming apparatus will be described, and then, a developer supplying system, that is, a developer replenishing apparatus and a supply container used in the image forming apparatus will be described.

(Image Forming Apparatus)

Figure 1:
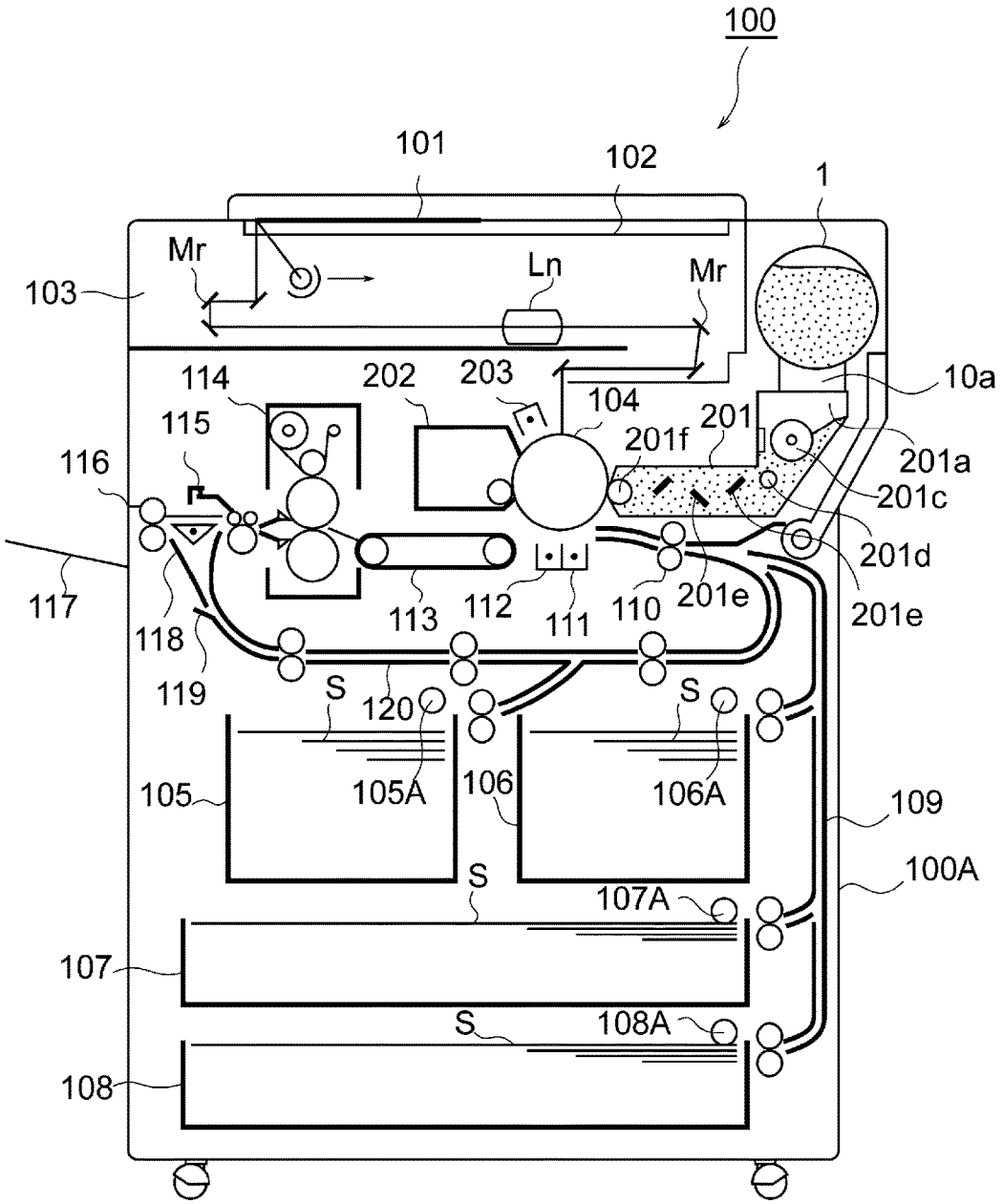
FIG. 1 is a sectional view of an image forming apparatus according to Embodiment 1.

FIG. 1 is a sectional view of an image forming apparatus 100 according to Embodiment 1 The image forming apparatus 100 is an example of an electrophotographic type copying machine (electrophotographic image forming apparatus) and is provided with a supplying device 201 to which a supply container 1 (so-called toner cartridge) is detachably mountable (demountable). The supply container 1 as the "developer supply container" is detachably mountable to the supplying device 201 as "developer supplying apparatus", that is, detachably mountable to a main assembly 100A of the image forming apparatus. Therefore, when the supply container 1 and/or the supplying device 201 is in the form of a cartridge, the cartridge is detachably mounted to the main assembly 100A.

The image forming apparatus 100 comprises the main assembly 100A. An original 101 is placed on an original supporting platen glass 102. A light image corresponding to image information of the original is imaged on an electrophotographic photosensitive drum 104 as an image bearing member by way of a plurality of mirrors M of an optical portion 103 and a lens Ln, so that an electrostatic image is formed. The electrostatic image is visualized with toner (one component magnetic toner) as a developer (dry powder) by a dry type developing device (one component developing device) 201*a*.

In this embodiment, the one component magnetic toner is used as the developer to be supplied from a supply container 1, but the present invention is not limited to the example and includes other examples which will be described hereinafter. Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Cassettes 105-108 accommodates recording materials (sheets) S. Of the sheet S stacked in the cassettes 105-108, an optimum cassette is selected on the basis of a sheet size of the original 101 or information inputted by the operator (user) from a liquid crystal operating portion of the copying machine. The recording material is not limited to a sheet of paper, but OHP sheet or another material can be used as desired. One sheet S supplied by a separation and feeding device 105A-108A is fed to registration rollers 110 along a feeding portion 109, and is fed at timing synchronized with rotation of a photosensitive drum 104 and with scanning of an optical portion 103.

Below the photosensitive drum 104, there are provided a transfer charger 111 and a separation charger 112. An image of the developer formed on the photosensitive drum 104 is transferred onto the sheet S by a transfer charger 111. Then, the sheet S carrying the developed image (toner image) transferred thereonto is separated from the photosensitive drum 104 by the separation charger 112. Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the main assembly 100A by the discharging roller 116. The trailing end thereof passes through a flapper 118, and a flapper 118 is controlled when it is still nipped by the discharging rollers 116, and the discharging rollers 116 are rotated reversely, so that the sheet S is refed into the main assembly 100A. Then, the sheet S is fed to the registration rollers 110 by way of re-feeding portions 119, 120, and then conveyed along the path similarly to the case of the one-sided copy mode and is discharged to the discharging tray 117.

In the main assembly 100A, around the photosensitive drum 104, there are provided image forming process equipment (process means) such as a developing device 201*a* as the developing means a cleaner portion 202 as a cleaning means, a primary charger 203 as charging means. The developing device 201*a* develops the electrostatic latent image formed on the photosensitive drum 104 by the optical portion 103 in accordance with image information of the 101, by depositing the developer (toner) onto the latent image. The primary charger 203 functions to uniformly charge the surface of the photosensitive drum 104 so that an intended electrostatic image is formed on the photosensitive drum 104. In addition, the cleanup portion 202 is to remove the developer remaining on the photosensitive drum 104.

(Supplying Device)

Part (a) of FIG. 2 is a partially sectional view of the developer supplying apparatus, (b) is a perspective view of a mounting portion, and (c) is a sectional view of the mounting portion. FIG. 3 is partly enlarged sectional views of a control system, the supply container 1 and the developer replenishing apparatus 201. FIG. 4 is a flow chart illustrating a flow of developer supply operation controlled by the control system. Referring to FIGS. 1-4, the supplying device 201 which is a constituent-element of the developer supplying system will be described. The supply container 1 as the "developer supply container" is detachably mountable to the supplying device 201 as the "developer supplying apparatus".

As shown in FIG. 1, the developer replenishing apparatus 201 comprises the mounting portion (mounting space) 10 (part (b) of FIG. 2), to which the supply container 1 is mounted dismountably, a hopper 10*a* for storing temporarily the developer discharged from the supply container 1, and the developing device 201*a*. As shown in part (c) of FIG. 2, the supply container 1 is mountable in a direction indicated by an arrow M to the mounting portion 10. Thus, a longitudinal direction (rotational axis direction) of the supply container 1 is substantially the same as the direction of arrow M. The direction of arrow M is substantially parallel with a direction indicated by X of part (b) of FIG. 7 which will be described hereinafter. In addition, a dismounting direction of the supply container 1 from the mounting portion 10 is opposite the direction (inserting direction) of the arrow M.

As shown in FIG. 1 and part (a) of FIG. 2, the developing device 201*a* comprises a developing roller 201*f* as the "developer carrying member" for carrying the developer, a stirring member 201*c*, and feeding members 201*d* and 201*e*. The developer supplied from the supply container 1 is stirred by the stirring member 201*c*, is fed to the developing roller 201*f* by the magnet roller 201*d* and the feeding member 201*e*, and is supplied to the photosensitive drum 104 by the developing roller 201*f*.

A developing blade 201 *g* for regulating an amount of developer coating on the roller is provided relative to the developing roller 201*f*, and a leakage preventing sheet 201*h* is provided contacted to the developing roller 201*f* to prevent leakage of the developer between the developing device 201*a* and the developing roller 201*f*.

As shown in part (b) of FIG. 2, the mounting portion 10 is provided with a rotation direction regulating portion (holding mechanism) 11 for limiting movement of the flange portion 4 in the rotational moving direction by abutting to a flange portion 4 (FIG. 6) of the supply container 1 when the supply container 1 is mounted.

Furthermore, the mounting portion 10 is provided with a developer receiving port (developer reception hole) 13 (FIG. 3) for receiving the developer discharged from the supply container 1, and the developer receiving port is brought into fluid communication with a second discharge opening (discharging port) 4*a* (FIG. 6) of the supply container 1 which will be described hereinafter, when the supply container 1 is mounted thereto. The developer is supplied from the second discharge opening 4*a* of the supply container 1 to the hopper 10*a* through the developer receiving port 13. In this embodiment, a diameter φ of the developer receiving port 13 is approx. 2 mm (pin hole), for the purpose of preventing as much as possible the contamination by the developer in the mounting portion 10. The diameter of the developer receiving ports 13 may be any if the developer can be discharged through the second discharge opening 4*a*.

As shown in FIG. 3, the hopper 10*a* comprises a feeding screw 10*b* for feeding the developer to the developing device 201*a* an opening 10*c* in fluid communication with the developing device 201*a* and a developer sensor (developer remainder amount sensor) 10*d* for detecting an amount of the developer accommodated in the hopper 10*a*.

As shown in parts (b) and (c) of FIG. 2, the mounting portion 10 is provided with a driving gear 300 functioning as a driving mechanism (driver). The driving gear 300 receives a rotational force from a driving motor 500 (FIG. 3) through a driving gear train, and functions to apply a rotational force to the supply container 1 which is set in the mounting portion 10.

As shown in FIG. 3, the driving motor 500 is controlled by a control device (CPU) 600. As shown in FIG. 3, the control device 600 controls the operation of the driving motor 500 on the basis of information indicative of a developer remainder inputted from the developer sensor 10*d*.

In this example, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 201 as compared with a structure in which forward and backward driving forces are provided by periodically rotating the driving motor 500 (driving gear 300) in the forward direction and backward direction.

(Mounting/Dismounting Method of Supply Container)

The description will be made as to mounting/dismounting method of the supply container 1. First, the operator opens an exchange cover and inserts and mounts the supply container 1 to a mounting portion 10 of the developer replenishing apparatus 201. With the mounting operation, the flange portion 4 of the supply container 1 is held and fixed in the developer replenishing apparatus 201. Thereafter, the operator closes the exchange cover to complete the mounting step. Thereafter, the control device 600 controls the driving motor 500, by which the driving gear 300 rotates at proper timing.

On the other hand, when the supply container 1 becomes empty, the operator opens the exchange cover and takes the supply container 1 out of the mounting portion 10. The operator inserts and mounts a new supply container 1 prepared beforehand and closes the exchange cover, by which the exchanging operation from the removal to the remounting of the supply container 1 is completed.

(Developer Supply Control by Developer Replenishing Apparatus)

Referring to a flow chart of FIG. 4, a developer supply control by the developer replenishing apparatus 201 will be described. The developer supply control is executed by controlling various equipment by the control device (CPU) 600. In this example, the control device 600 controls the operation/non-operation of the driving motor 500 in accordance with an output of the developer sensor 10*d* by which the developer is not accommodated in the hopper 10*a* beyond a predetermined amount.

The developer sensor 10*d* checks the accommodated developer amount in the hopper 10*a* (S100). When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (S101).

When the accommodated developer amount detected with developer sensor 10*d* is discriminated as having reached the predetermined amount, that is, when the developer is detected by the developer sensor 10*d*, as a result of the developer supplying operation, the control device 600 deactuates the motor 500 to stop the developer supplying operation (S102). By the stop of the supplying operation, a series of developer supplying steps is completed. Such developer supplying steps are carried out repeatedly whenever the accommodated developer amount in the hopper 10*a* becomes less than a predetermined amount as a result of consumption of the developer by the image forming operations.

FIG. 5 is a sectional view illustrating a structure in which the hopper 10*a* of FIG. 3 is omitted, and the developer is directly supplied to the developing device 800 from the supply container 1. In FIG. 3, the developer discharged from the supply container 1 is stored temporarily in the hopper 10*a*, and then is supplied into the developing device 201*a*, the supplying device 201 may have the structure of FIG. 5. FIG. 5 shows an example of a developing device 800 using two component developer supplied from the supplying device 201. The developing device 800 comprises a stirring chamber 800*x* into which the developer is stirred, and a developer chamber 800*y* for supplying the developer to the developing sleeve 800*a*, wherein the stirring chamber 800*x* and the developer chamber 800*y* are provided with stirring screws 800*b* rotatable in such directions that the developer is fed in the opposite directions from each other.

The stirring chamber 800*x* and the developer chamber 800*y* are communicated with each other in the opposite longitudinal end portions, and the two component developer are circulated the two chambers. The stirring chamber 800*x* is provided with a magnetometric sensor 800*c* for detecting a toner content of the developer, and on the basis of the detection result of the magnetometric sensor 800*c*, the control device 600 controls the operation of the driving motor 500. In such a case, the developer supplied from the supply container is non-magnetic toner or non-magnetic toner plus magnetic carrier.

In this example, as will be described hereinafter, the developer in the supply container 1 is hardly discharged through the second discharge opening 4*a* only by the gravitation, but the developer is discharged by a volume changing operation of a pump portion 3*b*, and therefore, variation in the discharge amount can be suppressed. Therefore, the supply container 1 which will be described hereinafter is usable for the example of FIG. 5 lacking the hopper 10*a*, and the supply of the developer into the developing chamber 800*y* is stable with such a structure.

(Developer Supply Container)

Referring to FIGS. 6 and 7, the structure of the supply container 1 which is a constituent-element of the developer supplying system will be described. Part (a) of FIG. 6 is a perspective view illustrating the supply container according to Embodiment 1 of the present invention, (b) is a partial enlarged view illustrating a state around a discharge opening, and (c) is a front view illustrating a state in which the supply container is mounted to the mounting portion of the developer supplying apparatus. As shown in part (a) of FIG. 6, the supply container 1 includes a developer accommodating portion 2 (container body) having a hollow cylindrical inside space for accommodating the developer. In this example, a cylindrical portion 2*k* and the discharging portion 4*c* function as the developer accommodating portion 2.

Furthermore, the supply container 1 is provided with a flange portion 4 (non-rotatable portion) at one end of the developer accommodating portion 2 with respect to the longitudinal direction (developer feeding direction). The cylindrical portion 2 is rotatable relative to the flange portion 4. A cross-sectional configuration of the cylindrical portion 2*k* may be non-circular as long as the non-circular shape does not adversely affect the rotating operation in the developer supplying step. For example, it may be oval configuration, polygonal configuration or the like.

(Material of Supply Container)

In this example, as will be described hereinafter, the developer is discharged through the discharge opening 4*a* by changing an internal volume of the supply container 1 by the pump portion 3*a*. Therefore, the material of the supply container 1 is preferably such that it provides an enough rigidity to avoid collision or extreme expansion against the volume change.

In addition, in this example, the supply container 1 is in fluid communication with an outside only through the discharge opening 4*a*, and is sealed except for the discharge opening 4*a*. Such a hermetical property as is enough to maintain a stabilized discharging performance in the discharging operation of the developer through the discharge opening 4*a* is provided by the decrease and increase of the volume of supply container 1 by the pump portion 3*a*.

Under the circumstances, this example employs polystyrene resin material as the materials of the developer accommodating portion 2 and the discharging portion 4*c* and employs polypropylene resin material as the material of the pump portion 3*a*. As for the material for the developer accommodating portion 2 and the discharging portion 4*c*, other resin materials such as ABS (acrylonitrile, butadiene, styrene copolymer resin material), polyester, polyethylene, polypropylene, for example are usable if they have enough durability against the volume change. Alternatively, they may be metal.

As for the material of the pump portion 3*a*, any material is usable if it is expansible and contractable enough to change the internal pressure of the supply container 1 by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump portion 3*a*, developer accommodating portion 2 and the discharging portion 3*h*, respectively. In the following, the description will be made as to the structures of the flange portion 4, the cylindrical portion 2*k*, the pump portion 3*a*, the gear portion 2*d*, and a cam groove 2*e*.

(Flange Portion)

Referring to FIG. 7, the flange portion 4 will be described. Part (a) of FIG. 7 is a perspective view of a section of the supply container 1, part (b) of FIG. 7 is a partially sectional view showing a most contracted usable state of the pump portion 3*a*, and part (c) of FIG. 7 is an enlarged view of the neighborhood of the storage portion 4*d* of the supply container 1. In these Figures, some parts are omitted for better illustration.

As shown in parts (a) and (b) of FIG. 7, there is provided a hollow discharging portion (developer discharging chamber) 4*c* for temporarily accommodating the developer supplied from the cylindrical portion 2*k*. The bottom of the discharging portion 4*c* is provided with the first discharge opening 4*e* for permitting discharge of the developer from the discharging portion 4*c*. Below the first discharge opening 4*e*, the second discharge opening 4*a* of the shutter 4*b* is disposed. The second discharge opening 4*a* as the discharge opening is provided in the cylindrical portion 2*k* to permit discharge of the developer. Above the first discharge opening 4*e*, the storage portion 4*d* is provided. The storage portion 4*d* is capable of storing a predetermined amount of the developer in the cylindrical portion 2*k* through the second discharge opening 4*a*.

Between the discharging portion 4*c* and the pump portion 3*a*, a partition as a suppressing portion is provided. The partition 20 isolates the space of the discharging portion 4*c* from the space in the pump portion 3*a*, so that the developer in the accommodating portion 2 is not able to freely move between the pump portion 3*a* and the discharging portion 4*c*. As shown in part (c) of FIG. 7, the partition 20 constitutes a fluid communication path 20*a* for fluid communication with the storage portion 4*d*. The partition 20 and the fluid communication path 20*a* will be described in detail hereinafter.

The flange portion 4 is provided with a shutter 4*b* for opening and closing the first discharge opening 4*e*. The shutter 4*b* is provided with the small second discharge opening 4*a* for supplying the developer into the supplying device 201, wherein the second discharge opening 4*a* is brought into fluid communication with the first discharge opening 4*e* with the mounting operation of the supply container 1. With the mounting operation of the supply container 1 to the mounting portion 10, the shutter 4*b* is brought into abutment to the abutting portion 21 (part (b) of FIG. 2) provided in the mounting portion 10.

Therefore, the shutter 4*b* slides relative to the supply container 1 in the rotational axis direction (opposite from the arrow M direction of part (c) of FIG. 2) of the cylindrical 2*k* with the mounting operation of the supply container 1 to the mounting portion 10. As a result, the second discharge opening 4*a* is brought into fluid communication with the first discharge opening 4*e*, thus completing the unsealing operation. At this time, the discharge opening 4*a* is positionally aligned with the developer receiving port 13 of the mounting portion 10, and therefore, they are brought into fluid communication with each other, thus enabling the developer supply from the supply container 1.

The flange portion 4 is constructed such that when the supply container 1 is mounted to the mounting portion 10 of the developer replenishing apparatus 201, it is stationary substantially. More particularly, a rotation regulating portion 11 shown in part (b) of FIG. 2 is provided so that the flange portion 4 does not rotate in the rotational direction of the cylindrical portion 2*k*. Therefore, in the state that the supply container 1 is mounted to the developer replenishing apparatus 201, the discharging portion 3*h* provided in the flange portion 3 is prevented substantially in the movement of the cylindrical portion 2*k* in the rotational moving direction (movement within the play is permitted). On the other hand, the cylindrical portion 2*k* is not limited in the rotational moving direction by the developer replenishing apparatus 201, and therefore, is rotatable in the developer supplying step.

In addition, as shown in as shown in part (a) of FIG. 7, a feeding member 6 in the form of a plate is provided to feed the developer fed from the cylindrical portion 2*k* by a helical projection (feeding projection) 2*c* to the discharging portion 4*c*. The feeding member 6 divides a part region of the developer accommodating portion 2 into substantially two parts, and integrally rotatable with the cylindrical portion 2*k*. The feeding member 6 is provided on each of the sides thereof with a plurality of inclination ribs 6*a* inclined toward the discharging portion 4*c* relative to the rotational axis direction of the cylindrical portion 2*k*. The inclination rib 6*a* as feeding portion rotates inside the cylindrical portion 2*k* to feed the developer.

With the above-described structure, the developer fed by the feeding projection 2*c* is scooped up by the plate-like feeding member 6 in interrelation with the rotation of the cylindrical portion 2*k*. Thereafter, with the further rotation of the cylindrical portion 2*k*, the developer slides down on the surface of the feeding member 6 by the gravity, and sooner or later, the developer is transferred to the discharging portion 4*c* by the inclination ribs 6*a*. With this structure of this example, the inclination ribs 6*a* are provided on each of the sides of the feeding member 6 so that the developer is fed into the discharging portion 4*c* and into the storage portion 4*b* for each half of the full-turn of the cylindrical portion 2*k*.

(Second Discharge Opening of Flange Portion)

In this example, the size of the second discharge opening 4*a* of the supply container 1 is so selected that in the orientation of the supply container 1 for supplying the developer into the developer replenishing apparatus 201, the developer is not discharged to a sufficient extent, only by the gravitation. The opening size of the second discharge opening 4*a* is so small that the discharging of the developer from the supply container is insufficient only by the gravitation, and therefore, the opening is called pin hole hereinafter. In other words, the size of the opening is determined such that the second discharge opening 4*a* is substantially clogged. This is expectedly advantageous in the following points:

(1) the developer does not easily leak through the second discharge opening 4*a*. (2) excessive discharging of the developer at time of opening of the second discharge opening 4*a* can be suppressed. (3) the discharging of the developer can rely dominantly on the discharging operation by the pump portion 3*a*. The inventors have investigated as to the size of the second discharge opening 4*a* not enough to discharge the toner to a sufficient extent only by the gravitation. The verification experiment (measuring method) and criteria will be described.

A rectangular parallelopiped container of a predetermined volume in which a discharge opening (circular) is formed at the center portion of the bottom portion is prepared, and is filled with 200 g of developer; then, the filling port is sealed, and the discharge opening is plugged; in this state, the container is shaken enough to loosen the developer. The rectangular parallelopiped container has a volume of 1000 cm^3, 90 mm in length, 92 mm width and 120 mm in height.

Thereafter, as soon as possible the discharge opening is unsealed in the state that the discharge opening is directed downwardly, and the amount of the developer discharged through the discharge opening is measured. At this time, the rectangular parallelopiped container is sealed completely except for the discharge opening. In addition, the verification experiments were carried out under the conditions of the temperature of 24 degree C. and the relative humidity of 55%.

Using these processes, the discharge amounts are measured while changing the kind of the developer and the size of the discharge opening. In this example, when the amount of the discharged developer is not more than 2 g, the amount is negligible, and therefore, the size of the discharge opening at that time is deemed as being not enough to discharge the developer sufficiently only by the gravitation.

The developers used in the verification experiment are shown in Table 1. The kinds of the developer are one component magnetic toner, non-magnetic toner for two component developer developing device and a mixture of the non-magnetic toner and the magnetic carrier.

As for property values indicative of the property of the developer, the measurements are made as to angles of rest indicating flowabilities, and fluidity energy indicating easiness of loosing of the developer layer, which is measured by a powder flowability analyzing device (Powder Rheometer FT4 available from Freeman Technology).

TABLE 1

| Developers | Volume average particle size of toner (μm) | Developer component | Angle of rest (deg.) | Fluidity energy (Bulk density of 0.5 g/cm$^3$) |
|---|---|---|---|---|
| A | 7 | Two-component non-magnetic | 18 | $2.09 \times 10^{-3}$ J |
| B | 6.5 | Two-component non-magnetic toner + carrier | 22 | $6.80 \times 10^{-4}$ J |
| C | 7 | One-component magnetic toner | 35 | $4.30 \times 10^{-4}$ J |
| D | 5.5 | Two-component non-magnetic toner + carrier | 40 | $3.51 \times 10^{-3}$ J |
| E | 5 | Two-component non-magnetic toner + carrier | 27 | $4.14 \times 10^{-3}$ J |

Referring to FIG. 8, a measuring method for the fluidity energy will be described. Parts (a) and (b) of FIG. 8 are schematic views of a device for measuring fluidity energy. The principle of the powder flowability analyzing device is that a blade is moved in a powder sample, and the energy required for the blade to move in the powder, that is, the fluidity energy, is measured. The blade is of a propeller type, and when it rotates, it moves in the rotational axis direction simultaneously, and therefore, a free end of the blade moves helically.

The propeller type blade 54 is made of SUS (type=C210) and has a diameter of 48 mm, and is twisted smoothly in the counterclockwise direction. More specifically, from a center of the blade of 48 mm×10 mm, a rotation shaft extends in a normal line direction relative to a rotation plane of the blade, a twist angle of the blade at the opposite outermost edge portions (the positions of 24 mm from the rotation shaft) is 70°, and a twist angle at the positions of 12 mm from the rotation shaft is 35°.

The fluidity energy is total energy provided by integrating with time a total sum of a rotational torque and a vertical load when the helical rotating blade 54 enters the powder layer and advances in the powder layer. The value thus obtained indicates easiness of loosening of the developer powder layer, and large fluidity energy means less easiness and small fluidity energy means greater easiness.

In this measurement, as shown in FIG. 8, the developer T is filled up to a powder surface level of 70 mm (L2 in FIG. 8) into the cylindrical container 53 having a diameter φ of 50 mm (volume=200 cc, L1 (FIG. 8)=50 mm) which is the standard part of the device. The filling amount is adjusted in accordance with a bulk density of the developer to measure. The blade 54 of φ48 mm which is the standard part is advanced into the powder layer, and the energy required to advance from depth 10 mm to depth 30 mm is displayed.

The set conditions at the time of measurement are, The rotational speed of the blade 54 (tip speed=peripheral speed of the outermost edge portion of the blade) is 60 mm/s: The blade advancing speed in the vertical direction into the powder layer is such a speed that an angle θ (helix angle) formed between a track of the outermost edge portion of the blade 54 during advancement and the surface of the powder layer is 10°: The advancing speed into the powder layer in the perpendicular direction is 11 mm/s (blade advancement speed in the powder layer in the vertical direction=(rotational speed of blade)×tan (helix angle×π/180)): and The measurement is carried out under the condition of temperature of 24 degree C. and relative humidity of 55%.

The bulk density of the developer when the fluidity energy of the developer is measured is close to that when the experiments for verifying the relation between the discharge amount of the developer and the size of the discharge opening, is less changing and is stable, and more particularly is adjusted to be 0.5 g/cm^3.

The verification experiments were carried out for the developers (Table 1) with the measurements of the fluidity energy in such a manner. FIG. 9 is a graph showing a relation between a diameter of a discharge opening and a discharge amount, for various developers.

From the verification results shown in FIG. 9, it has been confirmed that the discharge amount through the discharge opening is not more than 2 g for each of the developers A-E, if the diameter φ of the discharge opening is not more than 4 mm (12.6 mm^2 in the opening area (circle ratio=3.14)). When the diameter φ discharge opening exceeds 4 mm, the discharge amount increases sharply. It will suffice if in the case that the fluidity energy of the developer (0.5 g/cm^3 of the bulk density) is not less than 4.3×10^-4 kg-m^2/s^2 (J) and not more than 4.14×10^-3 kg-m^2/s^2 (J), the diameter of the second discharge opening 4*a* is not more than 4 mm (12.6 (mm^2) of the opening area of the second discharge opening 4*a*).

As for the bulk density of the developer, the developer has been loosened and fluidized sufficiently in the verification experiments, and therefore, the bulk density is lower than that expected in the normal use condition (left state), that is, the measurements are carried out in the condition in which the developer is more easily discharged than in the normal use condition.

The verification experiments were carries out as to the developer A with which the discharge amount is the largest in the results of FIG. 9, wherein the filling amount in the container were changed in the range of 30-300 g while the diameter φ of the discharge opening is constant at 4 mm. The verification results are shown in FIG. 10. From the results of FIG. 10, it has been confirmed that the discharge amount through the discharge opening hardly changes even if the filling amount of the developer changes. From the foregoing, it has been confirmed that by making the diameter φ of the discharge opening not more than 4.0 mm (12.6 mm^2 in the area), the developer is not discharged sufficiently only by the gravitation through the discharge opening in the state that the discharge opening is directed downwardly (supposed supplying attitude into the developer replenishing apparatus 201) irrespective of the kind of the developer or the bulk density state.

On the other hand, the lower limit value of the size of the second discharge opening 4*a* is preferably such that the developer to be supplied from the supply container 1 (one component magnetic toner, one component non-magnetic toner, two component non-magnetic toner or two component magnetic carrier) can at least pass therethrough. More particularly, the discharge opening is preferably larger than a particle size of the developer (volume average particle size in the case of toner, number average particle size in the case of carrier) contained in the supply container 1. For example, in the case that the supply developer comprises two component non-magnetic toner and two component magnetic carrier, it is preferable that the discharge opening is larger than a larger particle size, that is, the number average particle size of the two component magnetic carrier.

Specifically, in the case that the supply developer comprises two component non-magnetic toner having a volume average particle size of 5.5 μm and a two component magnetic carrier having a number average particle size of 40 μm, the diameter of the second discharge opening 4*a* is preferably not less than 0.05 mm (0.002 mm^2 in the opening area).

If, however, the size of the second discharge opening 4*a* is too close to the particle size of the developer, the energy required for discharging a desired amount from the supply container 1, that is, the energy required for operating the pump portion 3*a* is large. It may be the case that a restriction is imparted to the manufacturing of the supply container 1. In order to mold the second discharge opening 4*a* in a resin material part using an injection molding method, a metal mold part for forming the second discharge opening 4*a* is used, and the durability of the metal mold part will be a problem. From the foregoing, the diameter φ of the second discharge opening 4*a* is preferably not less than 0.5 mm.

In this example, the configuration of the second discharge opening 4*a* is circular, but this is not inevitable. A square, a rectangular, an ellipse or a combination of lines and curves or the like are usable if the opening area is not more than 12.6 mm^2 which is the opening area corresponding to the diameter of 4.0 mm.

However, a circular discharge opening has a minimum circumferential edge length among the configurations having the same opening area, the edge being contaminated by the deposition of the developer. However, a circular discharge opening has a minimum circumferential edge length among the configurations having the same opening area, the edge being contaminated by the deposition of the developer. In addition, with the circular discharge opening, a resistance during discharging is also small, and a discharging property is high. Therefore, the configuration of the second discharge opening 4*a* is preferably circular which is excellent in the balance between the discharge amount and the contamination prevention.

From the foregoing, the size of the second discharge opening 4*a* is preferably such that the developer is not discharged sufficiently only by the gravitation in the state that the second discharge opening 4*a* is directed downwardly (supposed supplying attitude into the developer replenishing apparatus 201). More particularly, a diameter φ of the second discharge opening 4*a* is not less than 0.05 mm (0.002 mm^2 in the opening area) and not more than 4.0 mm (12.6 mm^2 in the opening area). Furthermore, the diameter φ of the second discharge opening 4*a* is preferably not less than 0.5 mm (0.2 mm^2 in the opening area and not more than 4 mm (12.6 mm^2 in the opening area). In this example, on the basis of the foregoing investigation, the second discharge opening 4*a* is circular, and the diameter φ of the opening is 2 mm.

In this example, the number of the second discharge openings 4*a* is one, but this is not inevitable, and a plurality of discharge openings 4*a*, if the respective opening areas satisfy the above-described range. For example, in place of one developer receiving port 13 having a diameter φ of 3 mm, two second discharge openings 4*a* each having a diameter φ of 0.7 mm are employed. However, in this case, the discharge amount of the developer per unit time tends to decrease, and therefore, one second discharge opening 4*a* having a diameter φ of 2 mm is preferable.

(Cylindrical Portion)

Referring to FIGS. 6, 7, the cylindrical portion 2*k* functioning as the developer accommodating chamber will be described. The cylindrical portion 2*k* as the developer accommodating chamber is a chamber capable of accommodating the developer. As soon in FIGS. 6 and 7, an inner surface of the cylindrical portion 2*k* is provided with a feeding portion 2*c* which is projected and extended helically, the feeding projection 2*c* functioning as a feeding portion for feeding the developer accommodated in the developer accommodating portion 2 toward the discharging portion 4*c* (second discharge opening 4*a*) functioning as the developer discharging chamber, with rotation of the cylindrical portion 2*k*. The cylindrical portion 2*k* is formed by a blow molding method from an above-described resin material.

As shown in part (b) of FIG. 7, the cylindrical portion 2*k* is supported rotatably relative to the flange portion 4 with a flange seal 5*b* of a ring-like sealing member provided on the inner surface of the flange portion 4 being compressed.

By this, the cylindrical portion 2*k* rotates while sliding relative to the flange seal 5*b*, and therefore, the developer does not leak out during the rotation, and a hermetical property is provided. Thus, the air can be brought in and out through the second discharge opening 4*a*, so that desired states of the volume change of the supply container 1 during the developer supply can be accomplished.

(Pump Portion)

Referring to FIG. 7, the description will be made as to the pump portion (reciprocable pump) 3*a* in which the volume thereof changes with reciprocation.

The pump portion 3*a* of this example functions as a suction and discharging mechanism for repeating the sucking operation and the discharging operation alternately through the second discharge opening 4*a*. In other words, the pump portion 3*a* functions as an air flow generating mechanism for generating repeatedly and alternately air flow into the supply container and air flow out of the supply container through the second discharge opening 4*a*.

The pump portion 3*a* is a part in which the inner volume of the cylindrical portion 2*k* can be changed in the longitudinal direction of the supply container 1 to apply a pressure at least to the second discharge opening 4*a*. As shown in part (b) of FIG. 7, the pump portion 3*a* is provided at a position away from the discharging portion 4*c* in a direction X. Thus, the pump portion 3*a* does not rotate in the rotational direction of the cylindrical portion 2*k* together with the discharging portion 4*c*.

In this example, the pump portion 3*a* is a displacement type pump (bellow-like pump) of resin material in which the volume thereof changes with the reciprocation. More particularly, as shown in part (b) of FIG. 7, the bellow-like pump includes crests and bottoms periodically and alternately. Therefore, the pump portion 2*b* repeats the compression and the expansion alternately by the driving force received from the developer replenishing apparatus 201. Using the pump portion 3*a* of such a structure, the volume of the supply container 1 can be alternately changed repeatedly at predetermined intervals. As a result, the developer in the discharging portion 4*c* can be discharged efficiently through the small diameter second discharge opening 4*a* (diameter of approx. 2 mm).

(Suppressing Portion)

As described in the foregoing, referring to part (a) of FIG. 7 and part (b) of FIG. 7, the partition 20 for isolation between the discharging portion 4*c* and the pump portion 3*a* is provided adjacent to the connecting portion between the pump portion 3*a* and the discharging portion 4*c* of the supply container 1. The partition 20 as the suppressing portion is provided at the connecting portion between the pump portion 3*a* and the discharging portion 4*c*, and at least in the discharging operation, the partition 20 functions to suppress the flow of the air produced by the pump portion 3*a* toward the cylindrical portion 2*k*.

In addition, as shown in part (c) of FIG. 7, a part of the partition 20 constitutes the fluid communication path 20*a* for fluid communication with the storage portion 4*d*. The fluid communication path 20*a* as the air hole portion is a passage for fluid communication between the pump portion 3*a* and the storage portion 4*d*. That is, the pump portion 3*a* is in fluid communication with the second discharge opening 4*a* or the discharging portion 4*c* through the fluid communication path 20*a* and the storage portion 4*d*. Therefore, when the pump portion 3*a* is compressed as described above, the produced air flow toward the outside is directed first to the storage portion 4*d* along the arrow shown in part (c) of FIG. 7, and then most of the air is discharged to the outside through the second discharge opening 4*a*.

Similarly, when the pump portion 3*a* is expanded, the produced air flow toward the inside of the supply container 1 is taken in first through the second discharge opening 4*a* in the direction opposite to that of the arrow as shown in part (c) of FIG. 7 and then sucked into the pump portion 3*a* through the fluid communication path 20*a* from the storage portion 4*d*. That is, in the supply container 1 of this embodiment, the air flow taken in and discharged out through the second discharge opening 4*a* flows through the fluid communication path 20*a* mainly between the pump portion 3*a*, the storage portion 4*d* and the second discharge opening 4*a*. Therefore, in the supply container 1 of this embodiment, the air flow produced by the pump portion 3*a* does not expand to the entirety of the discharging portion 4*c* or the cylindrical portion 2*k*, so that the pressure difference from the supply container 1 is locally large adjacent to the storage portion 4*d*.

In addition, the volume of the storage portion 4*d* is relatively very small as compared with that of the discharging portion 4*c* or the cylindrical portion 2*k*, and therefore, the local pressure difference produced in the neighborhood of the developer storage portion is very high as compared with the case of the conventional example of the supply container 1 in which the air flow is directed to the entirety of the developer accommodating space.

(Drive Receiving Mechanism)

The description will be made as to a drive receiving mechanism (drive receiving portion, driving force receiving portion) of the supply container 1 for receiving the rotational force for rotating the cylindrical portion 2*k* provided with feeding projection 2*c* from the developer replenishing apparatus 201. As shown in part (a) of FIG. 6, the supply container 1 is provided with a gear portion 2*a* which functions as a drive receiving mechanism (drive receiving portion, driving force receiving portion) engageable (driving connection) with a driving gear 300 (functioning as driving mechanism) of the developer replenishing apparatus 201. The gear portion 2*d* as the driving force receiving portion receives a rotational force for rotating the inclination rib 6*a* from the driving gear 300 of the supplying device 201.

Therefore, the rotational force inputted to the gear portion 2*d* from the driving gear 300 (FIG. 6) is transmitted to the pump portion 3*a* through a reciprocation member 3*b* shown in part (a) and (b) of FIG. 11, as will be described in detail hereinafter. The bellow-like pump portion 3*a* of this example is made of a resin material having a high property against torsion or twisting about the axis within a limit of not adversely affecting the expanding-and-contracting operation.

In this example, the gear portion 2*d* is provided at one longitudinal end (developer feeding direction) of the cylindrical portion 2*k*, but this is not inevitable, and the gear portion 2*a* may be provided at the other longitudinal end side of the developer accommodating portion 2, that is, the trailing end portion. In such a case, the driving gear 300 is provided at a corresponding position.

In this example, a gear mechanism is employed as the driving connection mechanism between the gear portion 2*d* of the supply container 1 and the gear 300 of the developer replenishing apparatus 201, but this is not inevitable, and a known coupling mechanism, for example is usable. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

(Drive Converting Mechanism)

Referring to FIG. 11, a drive converting mechanism (drive converting portion) for the supply container 1 will be described. In this example, a cam mechanism is taken as an example of the drive converting mechanism. Part (a) of FIG. 11 is a partial view in a state in which the pump portion is expanded to the maximum usable limit, (b) is a partial view in a state in which the pump portion is contracted to the maximum usable limit, and (c) is a partial view of the pump portion. As shown in part (a) of FIG. 11, the supply container 1 is provided with the cam mechanism which functions as the driving force converting mechanism for converting the rotational force for rotating the cylindrical portion 2*k* received by the gear portion 2*d* to a force in the reciprocating directions of the pump portion 3*a*.

In this example, one drive receiving portion (gear portion 2*d*) receives the driving force for rotating the cylindrical portion 2*k* and for reciprocating the pump portion 3*a*, and the rotational force received by converting the rotational driving force received by the gear portion 2*d* to a reciprocation force in the supply container 1 side.

Because of this structure, the structure of the drive receiving mechanism for the supply container 1 is simplified as compared with the case of providing the supply container 1 with two separate drive receiving portions. In addition, the drive is received by a single driving gear of developer replenishing apparatus 201, and therefore, the driving mechanism of the developer replenishing apparatus 201 is also simplified.

As shown in part (a) of FIG. 11 and part (b) of FIG. 11, the used member for converting the rotational force to the reciprocation force for the pump portion 3*a* is the reciprocation member 3*b*. More specifically, it includes a rotatable cam groove 2*e* extended on the entire circumference of the portion integral with the driven receiving portion (gear portion 2*d*) for receiving the rotation from the driving gear 300. The cam groove 2*e* will be described hereinafter. The cam groove 2*e* is engaged with a reciprocation member engaging projection projected from the reciprocation member 3*b*.

The cam groove 2*e* and the reciprocation member 3*b* as driving force converting portion converts the received rotational force into a feeding driving force to rotate the inclination rib 6*a* through the gear portion 2*d* to feed the developer by the operation of the pump portion 3*a* in the longitudinal direction of the supply container 1. In this example, as shown in part (c) of FIG. 11, the reciprocation member 3*b* is limited in the movement in the rotational moving direction of the cylindrical portion 2*k* by a protecting member rotation regulating portion 3*f* (play will be permitted) so that the reciprocation member 3*b* does not rotate in the rotational direction of the cylindrical portion 2*k*. By the movement in the rotational moving direction limited in this manner, it reciprocates along the groove of the cam groove 2*e* (in the direction of the arrow X shown in FIG. 7 or the opposite direction).

A plurality of such reciprocation member engaging projections 3*c* are provided and are engaged with the cam groove 2*e*. More particularly, two engaging projections 3*c* are provided opposed to each other in the diametrical direction of the cylindrical portion 2*k* (approx. 180° opposing). The number of the engaging projections 3*c* is satisfactory if it is not less than one. However, in consideration of the liability that a moment is produced by the drag force during the expansion and contraction of the pump portion 3*a* with the result of unsmooth reciprocation, the number is preferably plural as long as the proper relation is assured in relation to the configuration of the cam groove 2*e* which will be described hereinafter.

In this manner, by the rotation of the cam groove 2*e* by the rotational force received from the driving gear 300, the reciprocation member engaging projection 3*c* reciprocates in the arrow X direction and the opposite direction along the cam groove 2*e*. By this, the pump portion 3*a* repeats the expanded state (part (a) of FIG. 11) and the contracted state (part (b) of FIG. 11) alternately, thus changing the volume of the supply container 1.

(Set Conditions of Drive Converting Mechanism)

In this example, the driving force converting mechanism effects the drive conversion such that an amount (per unit time) of developer feeding to the discharging portion 4*c* by the rotation of the cylindrical portion 2*k* is larger than a discharging amount (per unit time) to the developer replenishing apparatus 201 from the discharging portion 4*c* by the function of the pump portion.

This is because if the developer discharging power of the pump portion 2*b* is higher than the developer feeding power of the feeding projection 2*c* to the discharging portion 3*h*, the amount of the developer existing in the discharging portion 3*h* gradually decreases. In other words, it is avoided that the time period required for supplying the developer from the supply container 1 to the developer replenishing apparatus 201 is prolonged.

In addition, in the drive converting mechanism of this example, the drive conversion is such that the pump portion 3*a* reciprocates a plurality of times per one full rotation of the cylindrical portion 2*k*. This is for the following reasons.

In the case of the structure in which the cylindrical portion 2*k* is rotated inner the developer replenishing apparatus 201, it is preferable that the driving motor 500 is set at an output required to rotate the cylindrical portion 2*k* stably at all times. However, from the standpoint of reducing the energy consumption in the image forming apparatus 100 as much as possible, it is preferable to minimize the output of the driving motor 500. The output required by the driving motor 500 is calculated from the rotational torque and the rotational frequency of the cylindrical portion 2*k*, and therefore, in order to reduce the output of the driving motor 500, the rotational frequency of the cylindrical portion 2*k* is minimized.

However, in the case of this example, if the rotational frequency of the cylindrical portion 2*k* is reduced, a number of operations of the pump portion 3*a* per unit time decreases, and therefore, the amount of the developer (per unit time) discharged from the supply container 1 decreases. In other words, there is a possibility that the developer amount discharged from the supply container 1 is insufficient to quickly meet the developer supply amount required by the main assembly of the image forming apparatus 100.

If the amount of the volume change of the pump portion 3*a* is increased, the developer discharging amount per unit cyclic period of the pump portion 3*a* can be increased, and therefore, the requirement of the main assembly of the image forming apparatus 100 can be met, but doing so gives rise to the following problem. If the amount of the volume change of the pump portion 2*b* is increased, a peak value of the internal pressure (positive pressure) of the supply container 1 in the discharging stroke increases, and therefore, the load required for the reciprocation of the pump portion 2*b* increases.

For this reason, in this example, the pump portion 3*a* operates a plurality of cyclic periods per one full rotation of the cylindrical portion 2*k*. By this, the developer discharge amount per unit time can be increased as compared with the case in which the pump portion 3*a* operates one cyclic period per one full rotation of the cylindrical portion 2*k*, without increasing the volume change amount of the pump portion 3*a*. Corresponding to the increase of the discharge amount of the developer, the rotational frequency of the cylindrical portion 2*k* can be reduced. With the structure of this example, the required output of the driving motor 500 may be low, and therefore, the energy consumption of the main assembly of the image forming apparatus 100 can be reduced.

(Position of Driving Converting Mechanism)

As shown in FIG. 11, in this example, the driving force converting mechanism (cam mechanism constituted by the engaging projection 3*c* and cam groove 2*e*) is provided outside of developer accommodating portion 2. More particularly, the driving force converting mechanism is disposed at a position separated from the inside spaces of the cylindrical portion 2*k*, the pump portion 3*a* and the discharging portion 4*c*, so that the driving force converting mechanism does not contact the developer accommodated inside the cylindrical portion 2*k*, the pump portion 3 and the discharging portion 4.

By this, a problem which may arise when the driving force converting mechanism is provided in the inside space of the developer accommodating portion 2 can be avoided. More particularly, the problem is that by the developer entering portions of the driving force converting mechanism where sliding motions occur, the particles of the developer are subjected to heat and pressure to soften and therefore, they agglomerate into masses (coarse particle), or they enter into a converting mechanism with the result of torque increase. The problem can be avoided. Now, the description will be made as to the developer supplying step into the developer supplying apparatus 201 by the supply container 1.

(Developer Supplying Step)

Referring to FIGS. 11 and 12, a developer supplying step by the pump portion 3*a* will be described. FIG. 12 is an extended elevation illustrating a cam groove 21, in the above-described driving force converting mechanism (cam mechanism including the engaging projection 3*c* and the cam groove 2*e*. The details of the cam groove 2*e* will be described hereinafter.

In this example, as will be described hereinafter, the drive conversion of the rotational force is carries out by the driving force converting mechanism so that the suction stroke by the pump operation (suction operation through the second discharge opening 4*a*), the discharging stroke (discharging operation through the second discharge opening 4*a*) and the rest stroke by the non-operation of the pump portion (neither suction nor discharging is effected through the second discharge opening 4*a*) are repeated alternately. The suction stroke, the discharging stroke and the rest stroke will be described.

(Suction Stroke)

First, the suction stroke (suction operation through the first discharge opening 4*e* and the second discharge opening 4*a*) will be described. The above-described drive converting mechanism (cam mechanism) effects the sucking operation by changing the pump state from the most contracted state of the pump portion 3*a* shown in part (b) of FIG. 11 to the most expanded state of the pump portion 3*a* shown in part (a) of FIG. 11. The inside of the supply container 1 is substantially in sealed state except for the second discharge opening 4*a*, and the second discharge opening 4*a* is substantially closed by the developer T existing there. Therefore, with the increase of the inside volume of the supply container 1, the internal pressure of the supply container 1 decreases.

At this time, the internal pressure of the supply container 1 (local internal pressure in the neighborhood of the storage portion 4*d* and the inside of the pump portion 3*a*) becomes lower than the ambient pressure (external air pressure). Therefore, the air outside the supply container 1 flows into the inside of the supply container 1 through the second discharge opening 4*a* by the pressure difference between the inside and outside of the supply container 1. More particularly, as described hereinbefore, the air through the second discharge opening 4*a* under the provision of the partition 20 and the fluid communication path 20*a* moves into the pump portion 3*a* through the storage portion 4*d* and the fluid communication path 20*a* in the order named. At this time, the air is hardly directed toward the discharging portion 4*c*.

Because the air is taken into the inside of the supply container 1 through the second discharge opening 4*a* from the outside, the developer in the storage portion 4*d* existing above the second discharge opening 4*a* is loosened (fluidized). More particularly, the bulk density of the developer in the storage portion 4*d* decreases by the introduction of the air therein, so that the developer T is fluidized properly.

In this embodiment, by the provision of the partition 20, the air taken in through the second discharge opening 4*a* does not scatter into the discharging portion 4*c*, but is supplied directly into the pump portion 3*a* from the inside of the storage portion 4*d*. Therefore, in the supply container 1, the air flow produced by the pump portion 3*a* does not scatter to the entirety of the discharging portion 4*c* and/or the cylindrical portion 2*k*. As a result, the pressure difference from the outside of the supply container 1 is locally large adjacent to the storage portion 4*d*.

Because of the volume of the storage portion 4*d* is very small as compared with the discharging portion 4*c* and the cylindrical portion 2*k*, the above-described local pressure difference produced adjacent to the storage portion 4*d* is very high as compared with the case of the conventional example structure in which the air flow is distributed to the entirety of the accommodation space. Therefore, even when the developer in the storage portion 4*d* is packed due to the vibration or the like during the transportation, the developer can be assuredly fluidized. In addition, because the air is introduced in the supply container 1 through the second discharge opening 4*a*, the internal pressure of the supply container 1 is kept close to the ambient pressure (external air pressure) despite the increase of the volume.

By the fluidization of the developer in this manner, the possible packing of the developer T in the second discharge opening 4*a* during the discharging operation which will be described hereinafter can be prevented, so that the developer can be smoothly discharged through the second discharge opening 4*a*. Therefore, the amount of the developer T discharged through the second discharge opening 4*a* (amount per unit time) can be made substantially constant for a long-term.

This is not limited to the case that the suction operation is from the most contracted state to the most expanded state of the pump portion 3*a*, the suction operation is carried out even when the pump portion 3*a* stops partway, if the change of the internal pressure of the supply container 1 occurs. That is, the suction stroke is the state in which the engaging projection 3*c* is in engagement with the cam groove 2*h* shown in FIG. 12.

(Discharging Stroke)

The description will be made as to the discharging stroke (discharging operation through the second discharge opening 4*a*). The discharging operation is effected by the change of the state of the pump portion 3*a* from the most the expanded state shown in part (a) of FIG. 11 to the most contracted state shown in part (b) of FIG. 11. More particularly, by the discharging operation, the volume of the supply container 1 decreases. At this time, the inside of the supply container 1 is substantially sealed except for the second discharge opening 4*a*, and therefore, the second discharge opening 4*a* is substantially closed by the developer T before the developer is discharged. Therefore, by compressing the pump portion 3*a*, the internal pressure of the supply container 1 increases.

At this time, the internal pressure of the supply container 1 becomes higher than the ambient pressure (external air pressure), so that the developer T is discharged through the second discharge opening 4*a* by the pressure difference between the inner and outer of the supply container 1. In this embodiment, as described hereinbefore, the storage portion 4*d* of the pump portion 3*a* is in fluid communication with the second discharge opening 4*a* through the fluid communication path 20*a* formed by the partition 20 as described hereinbefore. Therefore, the air flow toward the outside produced by the compression of the pump portion 3*a* is hardly scattered in the discharging portion 4*c* but is concentrated on the storage portion 4*d*. Therefore, the developer T in the storage portion 4*d* fluidized by the suction stroke can be stably discharged. In addition, the air in the supply container 1 is also discharged together with the developer T, and therefore, the internal pressure of the supply container 1 decreases.

In the above-described the manner, according to this embodiment, by the provision of the partition 20, the air works efficiently to the storage portion 4*d*. As a result, as compared with the conventional supply container 1, the developer T can be stably discharged using a small amount of discharging air.

For effecting the discharging operation, it is not inevitable that the pump portion 3*a* changes from the most expanded state to the most contracted state, but the discharging operation is effected if the internal pressure of the supply container 1 changes even if the pump portion changes from the most expanded state halfway to the most contracted state. That is, the discharging stroke corresponds to the state in which the reciprocation member engaging projection 3*c* is engaged with the cam groove 2 *g* shown in FIG. 12.

(Rest Stroke)

The rest stroke in which the pump portion 3*a* does not to reciprocate will be described. In this example, as described hereinbefore, the operation of the driving motor 500 is controlled by the control device 600 on the basis of the results of the detection of the magnetometric sensor 800*c* and/or the developer sensor 10*d*. With such a structure, the amount of the developer discharged from the supply container 1 directly influences the toner content of the developer, and therefore, it is desirable to supply the amount of the developer required by the image forming apparatus from the supply container 1. At this time, in order to stabilize the amount of the developer discharged from the supply container 1, it is desirable that the amount of volume change at one time is constant.

If, for example, the cam groove 2*e* includes only the portions for the discharging stroke and the suction stroke, the motor actuation may stop at halfway of the discharging stroke or suction stroke. After the stop of the driving motor 500, the cylindrical portion 2*k* continues rotating by the inertia, by which the pump portion 3*a* continues reciprocating until the cylindrical portion 2*k* stops, during which the discharging stroke or the suction stroke continues. The distance through which the cylindrical portion 2*k* rotates by the inertia is dependent on the rotational speed of the cylindrical portion 2*k*. Further, the rotational speed of the cylindrical portion 2*k* is dependent on the torque applied to the driving motor 500. From this, the torque to the motor changes depending on the amount of the developer in the supply container 1, and the speed of the cylindrical portion 2*k* may also change, and therefore, it is difficult to stop the pump portion 3*a* at the same position.

In order to stop the pump portion 3*a* at the same position, a region in which the pump portion 3*a* does not reciprocate even during the rotation of the cylindrical portion 2*k* is desired to be provided in the cam groove 2*e*. In this embodiment, for the purpose of preventing the reciprocation of the pump portion 3*a*, there is provided a cam groove 2*i* (FIG. 12). The cam groove 2*i* extends in the rotational moving direction of the cylindrical portion 2*k*, and therefore, the reciprocation member 3*b* does not move despite the rotation (straight shape). That is, the rest stroke corresponds to the reciprocation member engaging projection 3*c* engaging with the cam groove 2*i*.

The non-reciprocation of the pump portion 3*a* means that the developer is not discharged through the second discharge opening 4*a* (except for the developer falling through the second discharge opening 4*a* due to the vibration or the like during the rotation of the cylindrical portion 2*k*). Thus, if the discharging stroke or suction stroke through the second discharge opening 4*a* is not effected, the cam groove 2*i* may be inclined relative to the rotational moving direction toward the rotation axial direction. When the cam groove 2*i* is inclined, the reciprocation of the pump portion 3*a* corresponding to the inclination is permitted.

(Change of Internal Pressure of Supply Container)

Verification experiments were carried out as to a change of the internal pressure of the supply container 1. The verification experiments will be described. The developer is filled such that the developer accommodating space in the supply container 1 is filled with the developer; and the change of the internal pressure of the supply container 1 is measured when the pump portion 3*a* is expanded and contracted in a range of 5 cm^3 of volume change. The internal pressure of the supply container 1 is measured using a pressure gauge (AP-C40 available from Kabushiki Kaisha KEYENCE) connected with the supply container 1.

Part (a) of FIG. 13 is a graph showing the pressure change when the pump portion 3*a* is expanded and contracted in the state the shutter 4*b* of the supply container 1 is open so that the second discharge opening 4*a* is in fluid communication with the outside. The ordinate is a relative pressure [kPa] of the inside of the supply container 1 to the ambient pressure (reference pressure (1 kPa)). Here, "+" means the positive pressure, and "−" means the negative pressure. The abscissa is the time [sec]. In part (a) of FIG. 13, the solid line shows the change of the pressure in the pump portion 3*a* (nearly equal to the pressure applied to the storage portion 4*d*), and the broken line shows the change of the pressure in the discharging portion 4*c*.

When the volume of the supply container 1 increases, the pressure of the supply container 1 becomes negative relative to the outside ambient pressure, and the air is taken in through the second discharge opening 4*a* by the pressure difference. When the volume of the supply container 1 decreases, the internal pressure of the supply container 1 becomes positive relative to the ambient pressure, so that the pressure is applied to the inside developer. At this time, the internal pressure is eased correspondingly to the amount of the discharged air and developer.

By the experiments, it has been confirmed that when the volume of the supply container 1 increases, the internal pressure of the supply container 1 becomes negative relative to the outside ambient pressure, and the air is taken in by the pressure difference. With the supply container 1 of the embodiment, it has been confirmed that the negative pressure inside the pump portion 3*a* and the discharging portion 4*c* is such that the pressure in the pump portion 3*a* is higher by delta P1. That is, by the provision of the partition 20 between the pump portion 3*a* and the discharging portion 4*c* and the provision of the fluid communication path 20*a* directly communicating the pump portion 3*a* and the storage portion 4*d* with each other, the air flow produced by the pump portion 3*a* is applied to the storage portion 4*d*.

Part (b) of FIG. 13 is a graph showing the results of the similar experiments with the conventional supply container. As shown in part (b) of FIG. 13, the internal pressure of the pump portion 3*a* of the supply container 1 is compared between this embodiment and conventional example. The ordinate and the abscissa in part (b) of FIG. 13 are the same as those in part (a) of FIG. 13. As will be evident from the graph of part (b) of FIG. 13, as compared with the conventional supply container, the pressure relative to the ambient pressure is larger by ΔP2 in the positive side and ΔP3 in the negative side. That is, with the supply container 1 of the embodiment, it has been confirmed that the higher pressure air can be applied to the developer in the storage portion 4*d* as compared with the conventional supply container.

As described hereinbefore, according to the supply container 1 of this Embodiment 1, by the provision of the partition 20, the air flow produced by the expanding-and-contracting operation of the pump portion 3*a* act on the storage portion 4*d* efficiently. Therefore, as compared with the case of the conventional supply container, the inside of the storage portion 4*d* can be easily pressurized to fluidize the developer T.

[Embodiment 2]

Part (a) of FIG. 18 is a perspective view of the flange portion 4 of the supply container 1 according to Embodiment 2, as seen from the accommodating portion 2. Part (b) of FIG. 18 is a sectional view of the flange portion 4. The supply container 1 of Embodiment 2 is different from the supply container 1 of Embodiment 1 in the partition 20, the fluid communication path 20*a* and the feeding member 6.

As shown in part (b) of FIG. 18, the flange portion 4 is provided with a partition 20 as the suppressing portion as a partition between the pump portion 3*a* and the accommodating portion 2. The partition 20 is provided with an annular rib 20*b* substantially at the center on the accommodating portion 2 side. The annular rib 20*b* is provided with a shaft sealing member 22 on the inside surface of the annular rib 20*b*. Inside of the annular rib 20*b*, there is provided a fluid communication path 20*a*. The fluid communication path 20*a* permits air flow the through together with the pump portion 3*a*, an opening 7*e* which will be described hereinafter, and the storage portion 4*d*.

The fluid communication path 20*a* is semicircle shape having an arcuation in the storage portion 4*d* side (lower side). In this embodiment, the shaft sealing member 22 is an oil seal (available from NOK Kabushiki Kaisha, Japan) which is engaged with a cylindrical shaft portion 7*k* of the feeding member 6 as will be described hereinafter to prevent leakage of the developer and the air. The shaft sealing member 22 may be sponge-like material such as urethane foam or the like to prevent the developer and/or the air.

Or, the clearance between the outer diameter of the cylindrical shaft portion 7*k* and the inner diameter of the annular rib 20*b* can be made so small that the developer and/or air leakage is suppressed. The other structures of the flange portion 4 are the same as those of Embodiment 1.

(Regulating Portion)

The regulating portion 7 of this embodiment will be described. Referring to FIGS. 18, 14, 15, 16, 17 and 19, the detailed description will be made. Part (a) of FIG. 14 is a perspective view of the feeding member 6 provided in the supply container 1. Part (b) of FIG. 14 it is a side view of the feeding member 6. Part (c) of FIG. 14 is a front view of the feeding member 6. In the FIGS. 15, 16 and 17, parts (a) are A-A sectional views of FIG. 19, illustrating the inside of the supply container 1 as seen from the pump portion 3*a* side of FIG. 19, in the supplying operation. In FIGS. 15, 16 and 17, parts (b) are B-B sectional views of FIG. 19, illustrating that the inside of the supply container 1 in the supplying operation.

As shown in part (a) of FIG. 14, the regulating portion 7 is provided integrally at a pump portion 3*a* side of the feeding member 6. Therefore, the regulating portion 7 rotates with the feeding member 6 which integrally rotates with the cylindrical portion 2*k*. The regulating portion 7 is a portion movable between the regulating position full limiting the flow of the developer into the storage portion 4*d* and the non-regulating position in which the flow of the developer into the storage portion 4*d* is not limited.

The regulating portion 7 includes thrust walls 7*a* and 7*b* and radial walls 7*c* and 7*d*.

The thrust walls 7*a* and 7*b* are respective walls parallel with each other with a gap S therebetween measured in the direction of the rotational axis (part (c) of FIG. 14). The radial walls 7*c* and 7*d* are respective walls having surfaces facing the in the circumferential direction of rotation. A storage portion opening 7*f* communicatable with the storage portion 4*d* is provided by two thrust walls 7*a* and 7*b* and radially outside end portions of two radial walls 7*c* and 7*d*.

That is, the position of the rotation shaft of the storage portion opening 7*f* is such that the storage portion opening 7*f* overlaps at least partly with the storage portion 4*d*. The cylindrical shaft portion 7*k* is formed in the neighborhood of the rotation axis of the pump portion 3*a* side on the thrust wall 7*a* and is inserted into the shaft sealing member 22 of the annular rib 20*b* to support the feeding member 6.

The pump portion 3*a* side end surface of the cylindrical shaft portion 7*k* is provided with an opening 7*e* in fluid communication with the storage portion opening 7*f*. A regulating portion 7 is a portion surrounded by the two thrust walls 7*a*, 7*b* and the radial walls 7*c*, 7*d*, and a fluid communication path 7*g* for establishing fluid communication between the opening 7*e* and the storage portion opening 7*f* is provided by the inside of the regulating portion 7. The regulating portion 7 moves to the regulating position in the discharging operation of the pump portion 3*a* to cover at least a part of the storage portion 4*d* to guide the air flow provided by the pump portion 3*a*. The fluid communication path 7*g* is a space surrounded by the thrust walls 7*a*, 7*b* and the radial walls 7*c*, 7*d* at the position indicated by the broken lines in part (a) of FIG. 14. That is, the fluid communication path 7*g* as the air hole portion is formed in a part of the regulating portion 7. The opening 7*e* is capable of being in fluid communication with the storage portion 4*d* the fluid communication path 7*g* and the storage portion opening 7*f*.

Referring to FIGS. 15, 16, 17 and 18, the operation of the regulating portion 7 in the developer supplying step will be described. FIG. 15 shows the state of the supply container in the operation rest step in which the pump portion 3*a* does not operate. In this case, the regulating portion 7 rotates with the rotation of the feeding member 6, but the storage portion opening 7*f* of the regulating portion 7 does not cover the first discharge opening 4*e* and the second discharge opening 4*a* formed in the bottom portion of the discharging portion 4*c*. The pump portion 3*a* does not reciprocate, and the internal pressure in the neighborhood of the storage portion 4*d* does not change.

As shown in part (b) of FIG. 15, the opening 7*e* is sealed by the partition 20 and is not in fluid communication with the fluid communication path 20*a*. That is, no fluid communication state is established between the storage portion 4*d* and the pump portion 3*a*. As a result, the regulating portion 7 does not act on the storage portion 4*d*, so that the developer T fed by the feeding member 6 and the neighborhood of the upper portion of the storage portion 4*d* flows into the storage portion 4*d* and is stored there (non-regulation state of the entering of the developer). When the feeding member 6 rotates from this position, the states become as shown in FIG. 16.

In the state shown in FIG. 16, the pump portion 3*a* is in the suction stroke which is from the most contracted state to the most expanded state. At this time, the regulating portion 7 rotates with the rotation of the feeding member 6, so that the storage portion opening 7*f* covers the upper portion of the storage portion 4*d* from the non-covering state. As shown in part (b) of FIG. 16, the opening 7*e* in fluid communication with the storage portion opening 7*f* in the storage portion (4*d*) covering side becomes in fluid communication with a part of the fluid communication path 20*a*. Thus, the pump portion 3*a* becomes in fluid communication with the storage portion 4*d* through the fluid communication path 20*a*, the opening 7*e* and the storage portion opening 7*f*. The other opening 7*e* is sealed by the partition 20 as the suppressing portion. In this embodiment, the partition 20 is rotatable integrally with the regulating portion. Substantially in the neighborhood of the central portion of the rotational axis of the partition 20, there is provided an opening which is in fluid communication with the opening 7*e*.

When the pump portion 3 expands in the suction stroke, the pressure in the pump portion 3*a* becomes negative, so that the air outside the supply container 1 flows into the supply container 1 through the second discharge opening 4*a* by the pressure difference between the inner and outer of the supply container 1, as shown in part (c) of FIG. 16. More particularly, the air taken in the second discharge opening 4*a* passes through the storage portion 4*d* and directs into the pump portion 3*a* through the storage portion opening 7*f* and the opening 7*e* from the fluid communication path 20*a*. At this time, as shown in part (c) of FIG. 16, the pump portion 3*a* is isolated from the discharging portion 4*c* by the partition 20, and therefore, the air is hardly distributed into the discharging portion 4*c*. That is, the partition 20 is provided between the pump portion and the discharging portion 4*c* in the rotational axis direction (rotational axis direction of the supply container).

As a result, the developer T stored in the storage portion 4*d* in the above-described stroke contains the air taken in through the second discharge opening 4*a*, and therefore, the bulk density becomes low, that is, fluidized. In addition, because of the air taken in the discharging portion 4*c* does not scatter, the momentum of the air passing through the storage portion 4*d* is large, so that the developer having been packed in the storage portion 4*d* by the transportation can be fluidized.

In the upper portion of the storage portion 4*d*, the radial wall 7*c* in the downstream of the regulating portion 7 with respect to the rotational direction of the rotational moving direction displaces the developer T in the upper portion of the storage portion 4*d* by the storage portion opening 7*f* of the regulating portion 7 covering the upper portion of the storage portion 4*d* with the rotation of the regulating portion 7. The storage portion opening 7*f* of the regulating portion 7 covers a part of the upper portion of the storage portion 4*d*. As a result, the flowing of the developer T in the neighborhood of the storage portion 4*d* into the storage portion 4*d* is limited by the thrust walls 7*a* and 7*b* and radial walls 7*c* and 7*d* of the regulating portion 7 (developer entering limited state). By the feeding member 6 rotating further, the state becomes as shown in FIG. 17.

In FIG. 17, the pump portion 3*a* is in the discharging stroke in which the pump portion 3*a* changes from the most expanded state to the most contracted state. At this time, the regulating portion 7 rotates with the rotation of the feeding member 6 so that at least a part of the storage portion opening 7*f* covers of the upper portion of the storage portion 4*d*. As shown in part (b) of FIG. 17, the opening 7*e* becomes in fluid communication with the fluid communication path 20*a*. That is, similarly to the state shown in part (b) of FIG. 16, the inside of the pump portion 3*a* is in fluid communication with the storage portion 4*d* through the fluid communication path 20*a*, the opening 7*e* and the storage portion opening 7*f*.

The other opening 7*e* is sealed by the partition 20. Thus, the air flow is directed positively toward the storage portion 4*d* from the inside of the pump portion 3*a*, and hardly scatters toward the discharging portion 4*c*. In this state, by the pump portion 3*a* contracting in the discharging stroke, the internal pressure of the supply container 1, more particularly, the internal pressure in the neighborhood of the storage portion 4*d* becomes higher than the ambient pressure. As a result, the developer T fluidized in the storage portion 4*d* by the suction stroke is discharged into the supplying device 201 together with the air through the second discharge opening 4*a*.

Also in the discharging stroke, too, the state in the upper portion of the storage portion 4*d* is such that with the rotation of the regulating portion 7, the radial wall 7*c* in the downstream side of the regulating portion 7 with respect to the rotational direction places the toner in the upper portion of the storage portion 4*d*, continuing from the state of the suction stroke. In addition, a part of the storage portion opening 7*f* of the regulating portion 7 always covers of the upper portion of the storage portion 4*d*. As a result, in the discharging stroke, the flowing of the developer T in the neighborhood of the upper portion of the storage portion 4*d* into the storage portion 4*d* is always limited by the thrust walls 7*a*, 7*b* and the radial walls 7*c*, 7*d* of the regulating portion 7 (developer entering limited state).

Here, the detailed description will be made as to the air flow in the supply container 1, which is applied to the developer Tin the storage portion 4*d* during the discharging stroke. The air in the discharging stroke to the storage portion 4*d* flows through following two ways. In one of them, the air flows from the pump portion 3*a* to the developer T in the storage portion 4*d* through the fluid communication path 20*a* of the partition 20, the opening 7*e* of the regulating portion 7, the fluid communication path 7*g* in the regulating portion 7 and the storage portion opening 7*f* in the order named.

In the other way, the air flows from the pump portion 3*a* to the developer T in the discharging portion 4*c* or cylindrical portion 4*k* through the fluid communication path 20*a* of the partition 20, the opening 7*e* of the regulating portion 7, the fluid communication path 7*g* in the regulating portion 7, the storage portion opening 7*f*, and a gap formed between the upper portion of the storage portion 4*d* and the lower end of the regulating portion 7.

However, the air flow to the storage portion 4*d* in the discharging stroke is mainly through the former way, for the following reason.

The developer T in the neighborhood of the outer periphery of the storage portion opening 7*f* of the regulating portion 7 covering the upper portion of the storage portion 4*d* in the discharging stroke is prevented from entering the storage portion 4*d* by the thrust walls 7*a*, 7*b* and the radial walls 7*c*, 7*d* of the regulating portion 7. Therefore, in the discharging portion 4*c* in the neighborhood of the outer periphery of the storage portion opening 7*f* of the regulating portion 7, the developer T stagnates. Therefore, the air flow toward the discharging portion 4*c* is resisted by the developer T. In the state, the developer T in the storage portion 4*d* resistance the airflow, similarly, but in the suction stroke in this embodiment, the air taken in through the second discharge opening 4*a* does not scatter toward the discharging portion 4*c* because of the provision of the partition 20, and the developer in the storage portion 4*d* is positively fluitized.

Therefore, the resistance of the developer T in the storage portion 4*d* against the air flow is much smaller than the resistance of the developer T stagnating in the discharging portion 4*c* against the air flow. As a result, the main air flow in the discharging stroke is directed to the storage portion 4*d*, because the resistance by the developer T against the air flow is smaller. In the discharging stroke, the developer T in the storage portion 4*d* which is in fluid communication with the fluid communication path 7*g* is discharged into the supplying device 201 together with the following air having passed through the fluid communication path 7*g* in the regulating portion 7. In addition, as described hereinbefore, in the discharging stroke, the storage portion 4*d* is always in the developer entering limited state by which the entering of the developer T is always limited by the regulating portion 7, and therefore, a substantially constant amount of the developer is stored in the storage portion 4*d*.

In addition, the internal pressure in the supply container 1 in the discharging stroke becomes equivalent to the ambient pressure at the time when the developer T in the storage portion 4*d* is discharged to give that with the air, by which the inside and the outside of the supply container 1 become in fluid communication with each other. Therefore, after the developer T in the storage portion 4*d* is discharged, no air flow is produced by the pressure difference for discharging the developer T from the supply container, and therefore, the developer T is hardly discharged. For this reason, in the discharging stroke, only the constant amount of the developer T stored in the storage portion 4*d* is discharged, and therefore, the developer can be discharged into the supplying device 201 with very high supply accuracy.

In addition, even if the developer T is packed in the fluid communication path 7*g*, for example, by the vibration during transportation, the packed state can be assuredly removed because the air flow produced by the contraction of the pump portion 3*a* is directed mainly through the fluid communication path 7*g* to the storage portion 4*d* according to this embodiment. Therefore, the air can be applied mainly on the storage portion 4*d* in that stabilized manner, and therefore, the developer T can be stably discharged into the supplying device 201. In addition, with the supply container 1 of the embodiment, the suction and discharging air mainly passes through the fluid communication path 7*g*, the amount of the developer T deposited in the fluid communication path 7*g* can be reduced, and therefore, the suction and discharging air can be applied to the storage portion 4*d* stably.

[Modified Example]

FIG. 21 is an enlargement perspective view of the feeding member 6 of the supply container 1 according to a modified example of Embodiment 2. In the description of this embodiment, the same reference numerals as in Embodiment 2 are assigned to the elements having the same structures and functions in this embodiment, and the detailed description thereof is omitted for simplicity. As shown in FIG. 21, with the supply container 1 of the modified example, the partition 20 is formed on the feeding member 6, and the partition 20 as the suppressing portion is integral with the opening 7*e* of the regulating portion 7. The partition 20 is mounted on the regulating portion 7. Therefore, the inside of the pump portion 3*a* is in fluid communication with the storage portion 4*d* through the opening 7*e*, the fluid communication path 7*g* and the storage portion opening 7*f*. The outer diameter of the partition 20 (the outer diameter of the regulating portion 7) and the inner diameter of the discharging portion 4*c* are so selected that a gap is provided therebetween to accomplish smooth rotation of the feeding member 6 relative to the flange portion 4. However, the gap is so small that the air flow is hardly influenced in the expanding-and-contracting operation of the pump portion 3*a*.

For this reason, the functions of the partition 20 and the air flow in the suction stroke and the discharging stroke are similar to the case of Embodiment 2. In this example, the partition 20 and the thrust wall 7*a* of the regulating portion 7 are on the same plane, and therefore, the dimension of the supply container 1 can be reduced as compared with Embodiment 2. More particularly, with the supply container 1 of Embodiment 2, the partition 20 and the thrust wall 7*a* are provided by separate members, respectively, and a relative rotation occurs between the partition 20 (provided on the flange portion 4) and the thrust wall 7*a* (provided on the feeding member 6). Therefore, a clearance is required in the thrust direction, for smooth relative rotation therebetween.

In other words, as compared with the structure of this example, the structure of Embodiment 2 requires additional length corresponding to the clearance (approx. 1 mm in that embodiment) plus the thickness of the partition (approx. 1.5 mm in that embodiment) in the thrust direction. Therefore, when the reduction of the length of the supply container 1 in the thrust direction is desired, the modified example is advantageous.

[Embodiment 3]

Part (a) of FIG. 22 is a perspective view of the flange portion 4 in the supply container 1 according to Embodiment 3. Part (b) of FIG. 22 is a sectional view illustrating a positional relation between the feeding member 6 and the flange portion 4 in the discharging stroke in this embodiment. In the description of this embodiment, the same reference numerals as in Embodiment 1 or 2 are assigned to the elements having the same structures in this embodiment, and the detailed description thereof is omitted for simplicity. The flange portion 4 of this embodiment is different from that of Embodiment 2 in a part of partition 20.

(Flange Portion)

As shown in part (a) of FIG. 22, the flange portion 4 is provided with the partition 20 as the suppressing portion. The partition 20 is provided with a fluid communication path 20*c* as a passable opening. The fluid communication path 20*c* is provided below the fluid communication path 20*a* and provides a fluid communication path between the pump portion 3*a* and the cylindrical portion 2*k* to pass the developer T therethrough. The fluid communication path 20*c* is disposed above and adjacent to the upper portion of the storage portion 4*d*.

As shown in parts (a) and (b) of FIG. 22, as seen in the rotational axis direction of the supply container 1, the dimension measured in the widthwise direction of the fluid communication path 20*c* is selected such that the width is within the imaginary extension of the storage portion 4*d* in the vertical direction. In the change of the pump portion 3*a* to the discharging stroke, the regulating portion 7 is in the position opposing fluid communication path 20*c* as seen in the rotational axis direction of the supply container 1, so that the regulating portion 7 can limit the amount of the developer T going out of the fluid communication path 20*c*. The size of the fluid communication path 20*c* is so selected that the area is smaller than the cross-sectional area of the fluid communication path 20*a*, in order to positively apply the air flow produced by the pump portion 3*a* onto the fluid communication path 20*a*.

(Suction Stroke)

The suction stroke of the supply container 1 will be described. By the expansion of the pump portion 3*a*, the air is taken into the supply container 1, so that the developer T is stored in the neighborhood of the fluid communication path 20*c*. The air taken in through the second discharge opening 4*a* is supplied into the pump portion 3*a* through the storage portion 4*d*, the opening 7*e* and the fluid communication path 20*a*. The developer T in the storage portion 4*d* is fluitized by the air taken in. In this embodiment and also in Embodiment 2, a small amount of developer T is taken in pump portion 3*a* together with the air through the fluid communication path 20*a*. Therefore, in the period from the initial state in which a large amount of the developer is contained in the developer supply container to the near end of the service life of the developer container, a quite large amount of the developer T is accumulated in the pump portion 3*a*.

(Discharging Stroke)

The discharging stroke of the supply container 1 in this embodiment will be described. After the suction stroke in this embodiment, the pump portion 3*a* is contracted such that the air in the supply container 1 is discharged to the outside of the supply container 1 together with the developer T, similarly to the case of part (c) of FIG. 17. In the initial state of the developer container 1, a sufficient amount of the developer T is contained in the supply container 1, and the developer T stagnates adjacent to the fluid communication path 20*c*, and the stagnated developer functions as a resistance against the flow of the air, and therefore the air hardly flows into the fluid communication path 20*c*. Therefore, similarly to the case of supply container 1 of Embodiment 2, the air is discharged together with the developer T through the fluid communication path 20*a*, the opening 7*e*, storage portion 4*d* and the second discharge opening 4*a*.

As described hereinbefore, in this embodiment, in the initial state in which a large amount of the developer T is contained in the supply container 1, the air flow to the storage portion 4*d* in the suction discharging stroke is the same as in the supply container 1 of Embodiment 2.

However, the air flow becomes different from that in Embodiment 2, in the near end of the service life of the supply container 1 in which the amount of the developer T in the supply container 1 is small. More particularly, in the near end state, the flow of the air taken in through the second discharge opening 4*a* in the suction stroke includes the flow into the pump portion 3*a* through the storage portion 4*d*, the opening 7*e* and the fluid communication path 20*a*, similarly to the initial state. In addition, there is a flow of the air into the pump portion 3*a* through the storage portion 4*d* from the fluid communication path 20*c*. These two ways of flow are produced.

This is because the reduction of the contained developer T decreases the amount of the developer T stagnating in the neighborhood of the storage portion 4*d*. In such a case, the flow of the suction air is distributed widely, and therefore, the momentum of the air flow through the storage portion 4*d* is slightly smaller than that in the initial state. However, in the near in the state, the packed state of the developer T in the storing portion 4*d* has already been removed as compared with the initial state, and therefore, despite the slight reduction of the momentum of the air flow, the developer T can be fluitized.

Subsequently, in the discharging stroke, similarly to the suction stroke, the amount of the developer T stagnating in the neighborhood of the storage portion 4*d* is small. Therefore, the flow of the discharging air produced by the pump portion 3*a* includes the flow to the storage portion 4*d* from the opening 7*e* through the fluid communication path 20*a* and the flow toward the storage portion 4*d* from the pump portion 3*a* through the fluid communication path 20*c*. By the latter air flow, the developer T taken into and accumulate and in the pump portion 3*a* by the suction stroke is fed through the fluid communication path 20*c* into the storage portion 4*d*, and then is discharged through the second discharge opening 4*a*.

That is, the amount of the developer T accumulated in the pump portion 3*a* decreases. Therefore, when the supply container 1 is exchanged, the amount of the developer T the remaining in the supply container 1 is smaller than that in the case of the supply container 1 of Embodiment 2. The supply container 1 of this embodiment is better than that of Embodiment 2 in that the amount of the developer T remaining in the pump portion 3*a* in the near end of the service life of the supply container 1 can be reduced. By a reduction, the developer supply container of this embodiment is better from the standpoint of the running cost and environmental health, because the amount of the remaining developer T is small, and therefore, the user can use the developer T to the extent without remaining amount.

[Comparison Example]

FIG. 20 is a partly enlarged perspective view of a supply container 1 according to a comparison example (conventional example). The supply container 1 shown in FIG. 20 is not provided with the partition 20 on the flange portion 4, the fluid communication path 20*a* in the partition 20, the annular rib 20*b*, or the cylindrical shaft portion 7*k* of the regulating portion 7 of the feeding member 6. The other structures are the same as those of this Embodiment 2.

As shown in FIG. 20, in the conventional example, the partition 20 as the suppressing portion is not provided between the pump portion 3*a* and the discharging portion 4*c*, and the inside of the pump portion 3*a* and the inside of the discharging portion 4*c* are not isolated. Therefore, as shown in part (a) of FIG. 20, in the suction stroke, the total volume of the pump portion 3*a*, the discharging portion 4*c* and the cylindrical portion 2*k* increases by the increase of the inside volume of the pump portion 3*a*, by the expansion of the pump portion 3*a*, and the pressure in the supply container 1 decreases to less than the ambient pressure (negative pressure). The pressure difference of the neighborhood of the storage portion 4*d* and the ambient pressure is much smaller than that in the case of supply container 1 of Embodiment 2.

Therefore, the momentum of the air taken into the supply container 1 through the second discharge opening 4*a* is smaller. In addition, the air is taken in also through the second discharge opening 4*a* and the discharging portion 4*c* as well as the opening 7*e*. For this reason, the fluidizing function of the flow of the air into the storage portion 4*d* to the packed developer T is poorer. In order to provide the momentum of the air to the storage portion 4*d* equivalent to that of the embodiment, a larger inside volume of the pump portion 3*a* or larger expansion amount of the pump portion 3*a* of the supply container 1 of this embodiment would be required.

The expanding-and-contracting operation of the pump portion 3*a* is provided by converting the rotation of the supply container 1 to the reciprocation of the pump portion 3*a* by the drive converting mechanism (cam groove), and therefore, the increase of the inside volume and/or the expansion amount of the pump portion 3*a* is influential to the rotational force required by the supply container 1. More particularly, the increase of the rotational load required by the supply container 1 necessitates the increase of the driving power of the image forming apparatus side.

In the supply container 1 of this embodiment, by the function of the partition 20 and the fluid communication path 20*a* described in the foregoing, the air can be applied efficiently to the storage portion 4*d*. Therefore, the packed developer T in the developer container can be fluitized without increasing the expansion amount or the inside volume of the pump portion 3*a*.

In the supply container 1 of the comparison example, in the discharging stroke, the flow of the air produced in the contraction stroke of the pump portion 3*a* is directed to the discharging portion 4*c* as well as to the opening 7*e*, because no partition 20 is provided, and the pump portion 3*a* and the discharging portion 4*c* are in fluid communication with each other without isolation therebetween, as shown in part (b) of FIG. 20. For this reason, the flow of the air applied to the storage portion 4*d* through the opening 7*e* is smaller than that in the case of the supply container 1 of this embodiment, and therefore, the amount of the air to be used for the discharge of the developer T stored in the storage portion 4*d* is smaller.

As will be understood from the foregoing, according to this embodiment which employs the partition 20 and the opening 7*e* provided in the regulating portion 7 to the right of fluid communication between the inside of the pump portion 3*a* and the storage portion 4*d*, the constant amount of the developer T Stored in the storage portion 4*d* can be always discharged into the supplying device 201 in the discharging stroke. That is, the developer T can be discharged with highly stabilized supply accuracy.

In this embodiment, the feeding member 6 is provided with two such regulating portions 7, but this is not inevitable to the present invention. The two regulating portions 7 are provided corresponding to the two discharging strokes in the 360° rotation of the cylindrical portion 2*k*. If, for example, three discharging strokes are provided in the 360° rotation of the cylindrical portion 2*k*, three regulating portions 7 may be provided.

In addition, with the structure of this embodiment, the regulating portion 7 is provided integrally with the feeding member 6 which is the movable portion, as described above, and therefore, the regulating portion 7 integrally rotates together with the cylindrical portion 2*k*. In this structure, the driving force for rotating the cylindrical portion 2*k* and the driving force for reciprocating the pump portion 3*a* are received by a single drive receiving portion (gear portion 2*d*).

In addition, the driving force for rotating the regulating portion 7 is also received by a single drive receiving portion (gear portion 2*d*) together with the driving force for rotating the cylindrical portion 2*k*. That is, the structure of this embodiment requires to receive three driving forces for the rotation of the cylindrical portion 2*k*, for the reciprocation of the pump portion 3*a* and for the rotation of the regulating portion 7, and these three driving forces are received by one drive receiving portion (gear portion 2*d*).

Therefore, the structure of this embodiment can significantly simplify the structure of the drive inputting mechanism for the supply container 1, as compared with the case in which three drive receiving portions are provided in the supply container 1. In addition, because the driving forces are received by a single driving mechanism (driving gear 300) of the developer supplying apparatus 201, the driving mechanism for the developer supplying apparatus 201 is also significantly simplified.

[Verification]

The discharging performance of the developer supply containers Embodiment 1, Embodiment 2 and Embodiment 3 were verified as compared with the conventional developer supply container. The verification method and verification items are as follows.

First, predetermined vibration close to that during the transportation of the supply container 1 is imparted by a vibration impartment machine to pack the developer T in the supply container 1. The discharging operation is started at this state, and the number of pumping operations until the discharge of the developer T actually starts from the discharging operation start. In addition, the time periods from the discharging start to the stabilization of the discharge amount (nearly equal to stabilization time) are compared. Finally, the amounts of the developer T remaining in the supply container 1 in the near end of the discharging are compared. The results are shown in Table 2.

As to those factors such as the number of pumping operation, the stabilization time or the remaining developer T amount, there is no constant quantitative references for OK/NG determination, which may be different if the specification of the main assembly of the image forming apparatus to which the supply container 1 is mounted, or the like is different. Therefore, a relative comparison is made. Therefore, the level A, the level B and the level C are given in the order of the better relative performance. The same levels mean equivalent performance. As a result of the comparison verification, the supply container 1 of this embodiment is better in the performance.

TABLE 2

| | Discharge start pumping number | Time required for stabilization | Remaining developer amount T |
|---|---|---|---|
| Conventional example | Level C | Level C | Level A |
| Embodiment 1 | Level A | Level B | Level A |
| Embodiment 2 | Level A | Level A | Level B |
| Embodiment 3 | Level A | Level A | Level A |

As described in the foregoing, in this embodiment, by the provision of the partition 20 between the pump portion 3*a* and the discharging portion 4*c*, the flow of the air produced by the expanding-and-contracting operation of the pump portion 3*a* can be efficiently applied to the storage portion 4*d*. Therefore, as compared with the conventional supply container 1, the supply container 1 of this embodiment exhibits good discharging properties (number of pumping operations to the start of the toner discharge, the stabilization time).

According to the embodiments of the present invention, the air can be concentratedly applied to the discharging portion at the time of toner discharging, thus accomplishing stabilized developer discharge.

INDUSTRIAL APPLICABILITY

According to the present invention, the air can be concentrated to the discharging portion during the toner discharging, and therefore, the developer can be stably discharged.

The invention claimed is:

1. A developer supply container detachably mountable to a developer supplying apparatus, the developer supply container comprising:

a developer accommodating chamber capable of accommodating developer;

a discharge opening, provided on the developer accommodating chamber, for permitting discharge of the developer therein;

a storage portion provided in the developer accommodating chamber and capable of storing a predetermined amount of the developer to be supplied through the discharge opening;

a pump portion having a changeable inside volume with reciprocation and actable at least on the storage portion;

an air hole portion providing fluid communication between the pump portion and the storage portion; and a suppressing portion capable of suppressing air directed toward the developer accommodating chamber from the pump portions while permitting supply of air from the pump portion to the air hole portion at least in a discharging operation.

2. A developer supply container according to claim 1, further comprising:

a regulating portion movable between a regulating position for regulating flow of the developer to the storage portion and a non-regulating position not regulating the flow of the developer to the storage portion, wherein the regulating portion is moved to the regulating position to cover at least a part of the storage portion so as to guide the flow of the air produced by the pump portion when the pump portion carries out the discharging operation, and wherein the air hole portion is formed in a part of the regulating portion.

3. A developer supply container according to claim 2, wherein the regulating portion is rotatable, and the air hole portion is disposed adjacent to a rotation axis.

4. A developer supply container according to claim 3, wherein the suppressing portion is disposed between the regulating portion and the pump portion in a direction of the rotation axis of the regulating portion.

5. A developer supply container according to claim 4, wherein the suppressing portion has a circular shape, and the air hole portion is disposed adjacent to a center of the circular shape.

6. A developer supply container according to claim 2, wherein the suppressing portion is provided in the regulating portion and is rotatable integrally with the regulating portion.

7. A developer supply container according to claim 1, wherein a part of the suppressing portion is provided at a position vertically below the air hole portion, with an opening being provided in the part of the suppressing portion, and with the opening being capable of providing fluid communication between the pump portion and the developer accommodating chamber and capable of passing the developer therethrough.

8. A developer supplying apparatus comprising a mounting portion for mounting the developer supply container according to claim 1.

9. A developer supply container detachably mountable to a developer supplying apparatus, the developer supply container comprising:

a rotatable developer accommodating chamber capable of accommodating developer;

a developer discharging chamber in fluid communication with the developer accommodating chamber, the developer discharging chamber having a discharge opening for permitting discharge of the developer therein;

a storage portion provided in the developer discharging chamber and capable of storing a predetermined amount of the developer to be supplied through the discharge opening;

a pump portion having a changeable inside volume with reciprocation and actable at least on the storage portion;

a partition provided between the storage portion and the pump portion in a direction of an axis of the developer accommodating chamber and configured to partition between the accommodating chamber and the pump portion; and an air hole provided in an inner wall of the developer discharging chamber closer to the pump portion than the partition in the direction of the axis, the air hole being configured to provide fluid communication between the pump portion and the storage portion.

10. A developer supply container according to claim 9, the storage portion has a cylindrical shape.

11. A developer supply container according to claim 9, further comprising a developer feeding portion provided at a position closer to the developer accommodating chamber than the partition with respect to the direction of the axis of the developer accommodating chamber.

12. A developer supply container detachably mountable to a developer supplying apparatus, the developer supply container comprising:

a rotatable developer accommodating chamber capable of accommodating developer;

a developer discharging chamber in fluid communication with the developer accommodating chamber, the developer discharging chamber having a discharge opening for permitting discharge of the developer therein;

a storage portion provided in the developer discharging chamber and capable of storing a predetermined amount of the developer to be supplied through the discharge opening;

a pump portion having a changeable inside volume with reciprocation and actable at least on the storage portion;

a partition provided between the storage portion and the pump portion in a direction of an axis of the developer accommodating chamber and configured to partition between the accommodating chamber and the pump portion; and an air hole provided in the partition and configured to provide fluid communication between the pump portion and the storage portion.

13. A developer supply container according to claim 12, wherein the air hole is provided adjacent to the axis of the developer accommodating chamber.

14. A developer supply container according to claim 12, further comprising a rotatable member provided opposed to the partition and above the storing portion, the rotatable member including:

i) a rotatable hollow partition separating a part of a space as seen in the direction of a rotational axis of the rotatable member and having an inside space, the rotatable hollow partition being capable of rotating about the rotational axis of the rotatable member, ii) a circumferential opening provided at a circumferential portion of the partition, the circumferential opening being in fluid communication with the inside space, iii) a side opening provided in a side of the partition that is closer to the partition with respect to the rotational axis direction of the rotatable member to permit the fluid communication between the pump portion and the inside space, wherein the circumferential opening is capable of facing the storing portion, wherein the fluid communication is established between the pump portion and the storage portion by the side opening being opposed to the air hole portion.

15. A developer supply container according to claim 14, wherein the rotatable member further comprises a developer feeding portion for feeding the developer into a space formed between the first partition and the second partition.

16. A developer supply container according to claim 14, wherein, when the circumferential opening is opposed to do to the storing portion, the side opening is opposed to the air hole portion.

* * * * *